US011920445B2

(12) United States Patent
MacPhail et al.

(10) Patent No.: US 11,920,445 B2
(45) **Date of Patent: *Mar. 5, 2024**

(54) WELL INJECTION AND PRODUCTION METHODS, APPARATUS AND SYSTEMS

(71) Applicant: NCS MULTISTAGE, LLC., Houston, TX (US)

(72) Inventors: Warren Foster Peter MacPhail, Calgary (CA); Wolfgang Friedrich Johann Deeg, Duncan, OK (US)

(73) Assignee: NCS MULTISTAGE, LLC., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/840,220

(22) Filed: Jun. 14, 2022

(65) Prior Publication Data

US 2022/0307358 A1 Sep. 29, 2022

Related U.S. Application Data

(63) Continuation of application No. 17/130,784, filed on Dec. 22, 2020, now Pat. No. 11,377,940, which is a (Continued)

(51) Int. Cl.

| | |
|---|---|
| ***E21B 43/16*** | (2006.01) |
| ***E21B 17/10*** | (2006.01) |
| ***E21B 17/20*** | (2006.01) |
| ***E21B 33/12*** | (2006.01) |
| ***E21B 33/13*** | (2006.01) |
| ***E21B 33/134*** | (2006.01) |
| ***E21B 33/138*** | (2006.01) |
| ***E21B 34/10*** | (2006.01) |

(Continued)

(52) U.S. Cl.

CPC ..... *E21B 43/16* (2013.01); *E21B 17/1035* (2013.01); *E21B 33/13* (2013.01); *E21B 34/10* (2013.01); *E21B 43/12* (2013.01); *E21B 43/14* (2013.01); *E21B 43/26* (2013.01); *E21B 17/20* (2013.01); *E21B 33/12* (2013.01); *E21B 33/134* (2013.01); *E21B 33/138* (2013.01); *E21B 43/114* (2013.01); *E21B 43/38* (2013.01); *E21B 2200/06* (2020.05)

(58) Field of Classification Search

CPC ..... E21B 43/16; E21B 17/1035; E21B 33/13; E21B 34/10; E21B 43/12; E21B 43/14; E21B 43/26; E21B 43/38; E21B 17/20; E21B 33/12; E21B 33/134; E21B 33/138; E21B 43/114; E21B 2200/06

See application file for complete search history.

(56) References Cited

U.S. PATENT DOCUMENTS

| | | | | |
|---|---|---|---|---|
| 11,377,940 | B2 * | 7/2022 | MacPhail | E21B 34/10 |
| 2013/0228337 | A1 * | 9/2013 | Dombrowski | E21B 43/17 166/308.1 |

* cited by examiner

*Primary Examiner* — James G Sayre

(74) *Attorney, Agent, or Firm* — Nolte Lackenbach Siegel

(57) ABSTRACT

A method and system for enhancing petroleum production are provided, in which a fracturing operation can be conducted in a formation through a string and then petroleum is displaced from the fractured formation by selectively injecting fluid into selected fractures in the formation while other non-selected fractures remain without fluid injection. The injected fluid flows out into the fractured formation and enhances recovery from the non-selected fractures. Petroleum is selectively collected from the non-selected fractures.

23 Claims, 30 Drawing Sheets

Related U.S. Application Data continuation of application No. 15/222,090, filed on Jul. 28, 2016, now Pat. No. 10,890,057.

(60) Provisional application No. 62/197,712, filed on Jul. 28, 2015.

(51) Int. Cl.

| | |
|---|---|
| ***E21B 43/114*** | (2006.01) |
| ***E21B 43/12*** | (2006.01) |
| ***E21B 43/14*** | (2006.01) |
| ***E21B 43/26*** | (2006.01) |
| ***E21B 43/38*** | (2006.01) |

WELL INJECTION AND PRODUCTION METHODS, APPARATUS AND SYSTEMS

CROSS REFERENCE TO RELATED APPLICATIONS

This application is a continuation of and claims priority to U.S. application Ser. No. 17/130,784, filed Dec. 22, 2020; which claimed the earlier effective filing date of U.S. application Ser. No. 15/222,090, filed Jul. 28, 2016, now issued as U.S. Letters Patent 10,890,0557; which claimed priority to U.S. application 62/197,712, filed Jul. 28, 2015. These applications are incorporated herein in their entirety for all purposes, including the claim to priority and to an earlier effective filing date, to the extent consistent with the present application.

FIELD

The invention relates to methods, apparatus, and systems for petroleum production, and more specifically to methods, apparatus, and systems for enhancing petroleum production in a well.

BACKGROUND

Petroleum recovery from subterranean formations (sometimes also referred to as "reservoirs") typically commences with primary production (i.e., use of initial reservoir energy to recover petroleum). Since reservoir pressure depletes through primary production, primary production is sometimes followed by the injection of fluids, including for example water, hydrocarbons, chemicals, etc., into a wellbore in communication with the reservoir to maintain the reservoir pressure and to displace (sometimes also referred to as "sweep") petroleum out of the reservoir. One issue with injecting fluids to enhance petroleum recovery is how to efficiently sweep the reservoir fluids and expedite production.

In general, petroleum produces from a well due to the presence of a differential pressure gradient between the far field reservoir pressure and the pressure inside the wellbore. As the well produces, the reservoir pressure gradually decreases and the pressure gradient diminishes over time. This reduction in reservoir pressure usually causes a decline in production rates from the well.

Further, the permeability of the desired production fluid (i.e., liquid petroleum) within the reservoir rock reduces in the presence of another phase (e.g., gas phase). The presence of another phase has the effect of reducing the flow rate of the desired production fluid from the reservoir to the wellbore. In general, the reservoir fluid comprises a mixture of several types of hydrocarbons and other constituents. The phase of many of the constituents is dependent on the pressure and temperature of the reservoir. As the pressure of the reservoir reduces through production, some of the dissolved constituents may come out of solution and become a free gas phase. These gas-phase constituents may collect near the well in any region of the reservoir where the pressure has reduced to below the bubble point, which may block liquid petroleum from producing into the wellbore. This problem of two-phase flow resulting from reservoir pressure depletion may be prevented or minimized by injecting fluid into the wellbore to maintain reservoir pressure.

The oil and gas industry has progressed from producing petroleum using vertical wells to horizontal wells which are hydraulically stimulated creating transverse fractures that are typically perpendicular but sometimes are at oblique angles to the horizontal wellbore. These multi-fractured horizontal wells ("MFHW") are typically used in tight or shale gas and/or oil formations to improve well productivity. However, the decline rates of these MFHW may be very severe, which provides an opportunity for using a method for enhancing petroleum recovery.

SUMMARY OF THE INVENTION

Methods and apparatus have been invented for improving production from a wellbore.

In accordance with a broad aspect of the present invention, there is provided: a method for petroleum production from a well having a well section with a wellbore inner surface in communication with a formation containing reservoir fluid, the method comprising: creating a first set of zones and a second set of zones in the well section accessed through a string, the first set of zones being fluidly sealed from communication through an annulus in the wellbore to the second set of zones in the well section; injecting fracturing fluid through the string into each of the first set of zones and the second set of zones to fracture the formation; and selectively injecting injection fluid through the string into the formation via a selected first zone in the first set of zones.

In accordance with another broad aspect of the present invention, there is provided: a system for petroleum production from a wellbore defined within a wellbore wall in communication with a formation containing reservoir fluid, the system comprising: a well installation including an injection conduit extending inside the wellbore; and a production conduit extending inside the wellbore; an injection zone in the wellbore in fluid communication with an injection passage of the injection conduit; a production zone in the wellbore in fluid communication with a production passage inside the production conduit, the production zone being fluidly sealed from the injection zone inside the wellbore; a preformed hydraulic fracturing port in the injection zone; and a preformed port on the production conduit configured to permit fracturing of the production zone.

In accordance with a broad aspect of the present invention, there is provided: a wellbore string for installation in a wellbore defined within a wellbore wall in communication with a formation containing reservoir fluid, the wellbore string comprising: an injection conduit; a production conduit extending parallel to the injection conduit but fluidly isolated from the injection conduit, the production conduit having a wall with an outer wall surface and defining a production conduit fluid passage; at least one injection flow regulator connected into the string and including: an outer surface, an injection passage through which the injection conduit passes, a preformed port for providing fluid communication through the preformed port to the outer surface, and a closure for the preformed port configured for manipulation by a fracturing actuator tool; and at least one production flow regulator connected into the string and axially offset along the string from the at least one injection flow regulator and including: an exterior surface, an injection bore through which the injection conduit extends, a production bore connected in communication with the production conduit fluid passage, and a production port for providing fluid communication between the production bore and the exterior surface.

BRIEF DESCRIPTION OF THE DRAWINGS

Drawings are included for the purpose of illustrating certain aspects of the invention. Such drawings and the description thereof are intended to facilitate understanding and should not be considered limiting of the invention. Drawings are included, in which:

FIG. 15*e* is the assembled junction tool and FIG. 15*f* is an exploded view thereof;

DETAILED DESCRIPTION OF VARIOUS EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

An aspect of the present invention is to provide a system for use with a horizontal wellbore to allow simultaneous injection of fluid(s) for pressure maintenance and effective sweeping and production of petroleum out of the formation.

In one aspect, a method is described herein for enhancing petroleum production from a well having alternating injection and production pattern through the induced transverse fracture network so the injected fluid(s) may effectively sweep hydrocarbons linearly from one stage of induced fracture(s) (e.g., an injection stage) into an adjacent stage of induced fracture(s) (e.g., a production stage). This pattern can be repeated as many times as required depending on the number of fracture stages in the wellbore. This well injection and production method may be used for each well in a reservoir having multiple horizontal spaced-apart wells so that the effects of this method may be multiplied. The spacing between the injection and production interval can be adjusted to account for the formation permeability (i.e., tighter spacing for lower permeability formation).

In one broad aspect of the present invention, petroleum is displaced from a fractured wellbore by creating a plurality of zones, each in communication with at least a fracture in the wellbore, and selectively injecting a fluid into selected zones without injecting into the other non-selected zones. The selected zones and non-selected zones are fluidly sealed from one another in the wellbore. The injection fluid flows out into the fractured formation and enhances recovery in the non-selected zones. The non-selected zones are selectively allowed or not allowed to produce, depending on the circumstances. A sample method and system of the invention are disclosed herein.

Referring to FIGS. 1 to 6, a well has a heel transitioning from a substantially vertical section to a substantially horizontal section. The well may or may not be cased. The substantially horizontal section of the well is in communication with a plurality of fractures 2 in a formation 8 adjacent to the well, via a wellbore inner surface 11, at various locations along the length of the horizontal section.

Figure 2:
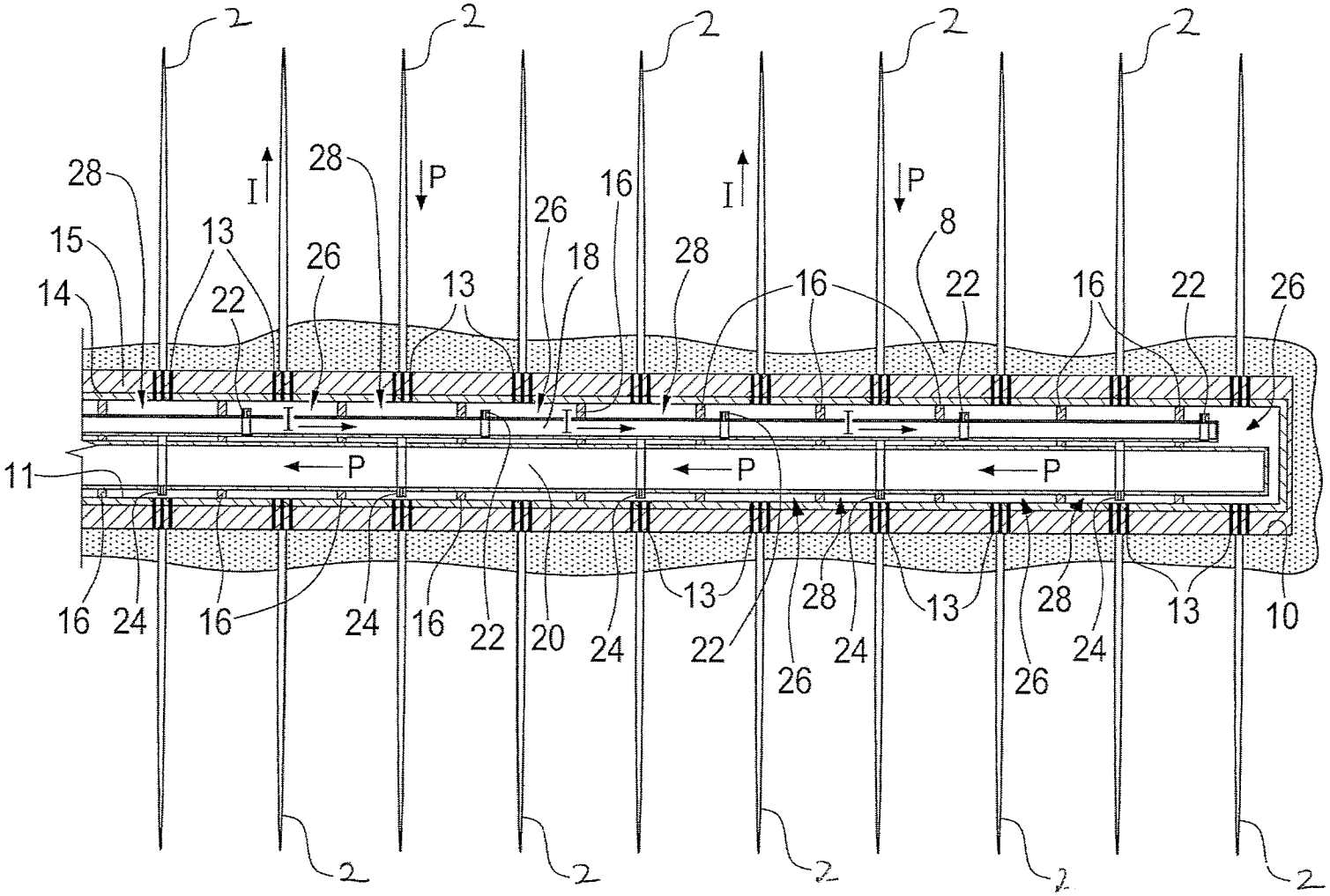
FIG. 2 is a cross-sectional view of one embodiment of the invention, where the system is installed in a cased and cemented horizontal well section.

In the illustrated embodiment in FIG. 2, at least a portion of the horizontal section of the well is lined with a casing string 14. The casing string 14 may be cemented to a wellbore wall 10 by a layer of concrete 15 formed in the annulus between the wellbore wall 10 and casing string 14. The annulus is the space between the casing string or strings and the wellbore wall. The space is called an annulus regardless of whether it is circular (i.e. a circular space between the circular outer diameter of one tubular and the circular inner diameter of the wellbore) or irregular (i.e., the space between the outer surfaces of a plurality of side-by-side tubulars and the wellbore wall). The casing string and concrete have intermittent perforations 13 along a lengthwise portion of the horizontal section which provide passageways connecting the inner surface of the casing string and fractures 2. For a cased well, the wellbore inner surface 11 of the horizontal section is the inner surface of the casing string 14. In one embodiment, a system of openhole packers (not shown) is provided on the outer surface of the casing string with valves placed therebetween, whereby the annular space between adjacent openhole packers can be hydraulically accessed via the valves.

Figure 3:
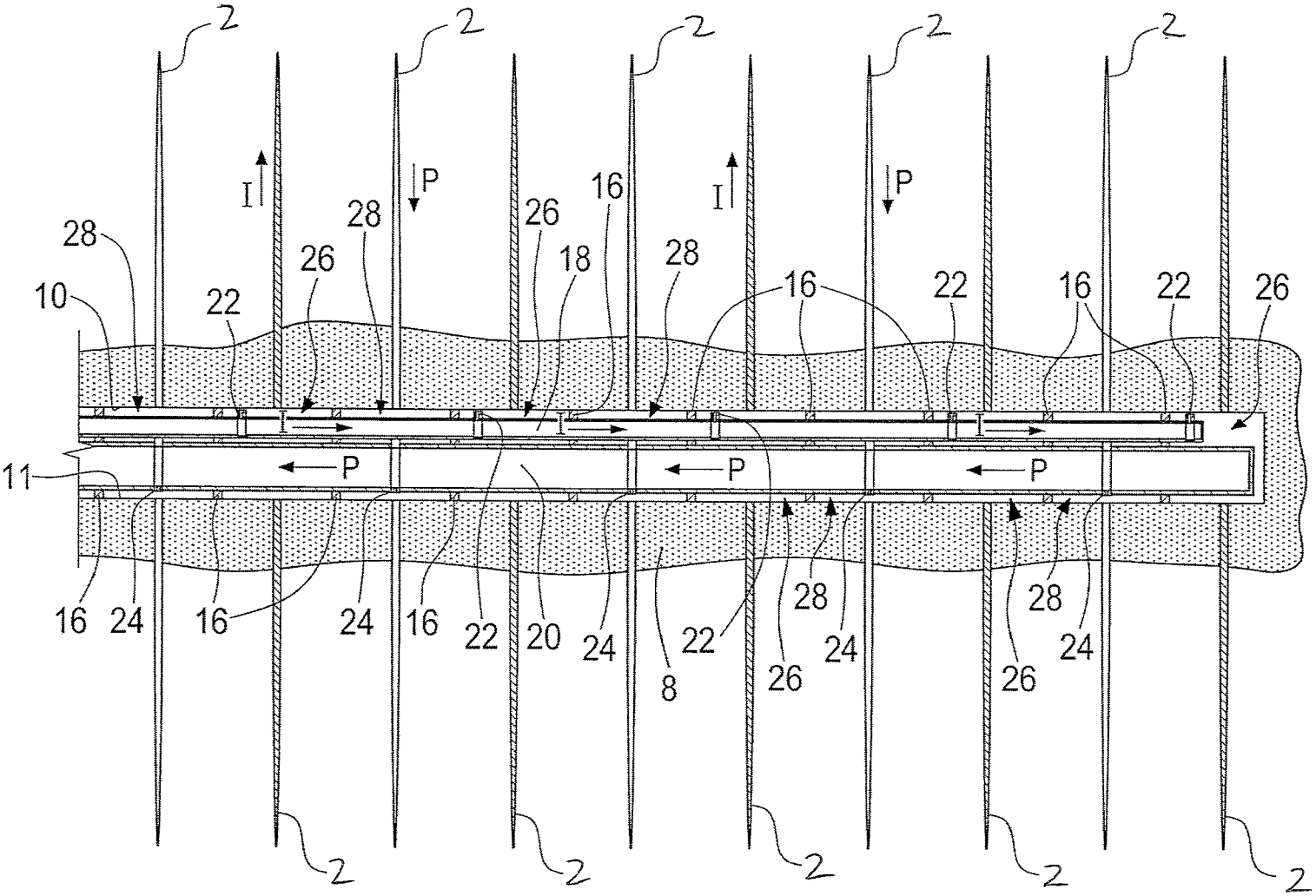
FIG. 3 is a cross-sectional view of another embodiment of the invention, where the system is installed in an unlined openhole horizontal well section.

In an embodiment as illustrated in FIG. 3, the well is uncased, so the wellbore is in direct communication with the fractures 2 via wellbore wall 10. For an uncased well, the wellbore inner surface 11 of the horizontal section is the wellbore wall 10. A person of ordinary skill in the art would know whether it would be beneficial to case the wellbore and/or to cement the casing 14 to the formation.

Fractures 2 may be natural fractures occurring in the formation, fractures that are formed by hydraulic fracturing, or a combination thereof. While fractures 2 are shown in the FIGS. to extend substantially perpendicular to the lengthwise axis of the horizontal section, fractures 2 may extend away from the wellbore at any angle relative to the lengthwise axis. Fractures that are formed by hydraulic fracturing may be substantially parallel with adjacent formed fractures.

There are a number of ways to initiate hydraulic fractures at specific locations in the wellbore, including for example by hydra jet, by staged hydraulic fracturing using various mechanical diversion tools and methods applicable to open wells or cased wells, by using a limited entry perforation and hydraulic fracture technique (which is generally applicable to cased cemented wells), etc. Other techniques for placing multiple hydraulic fractures in a horizontal well section include for example: a multiple repeated sequence of jet perforating the cased cemented hole followed by hydraulic fracturing with temporary isolation inside the wellbore using mechanical bridge plugs; wireline jet perforating the cased and cemented hole to initiate the hydraulic fracture at a specific interval while preventing the fracture treatment from re-entering previously fractured intervals using perforation ball sealers and/or other methods of diversion; hydra jet perforating with either mechanical packer or sand plug diversion; various open-hole packer and valve systems; and manipulating valves installed with the cemented casing using coiled tubing or jointed tubing deployed tools.

With reference to FIGS. 1 to 4, a system is shown for facilitating petroleum production from the formation 8. The system comprises an injection conduit 18 and a production conduit 20, both of which extend into the horizontal section of the wellbore. The injection conduit 18 supports injection flow regulators 22 at intermittent locations along a lengthwise section thereof to allow fluids inside the conduit to flow out via the flow regulators 22. The production conduit 20 supports production flow regulators 24 at intermittent locations along a lengthwise section thereof to allow fluids from outside the conduit to flow into the conduit via the flow regulators 24. One or both of conduits 18 and 20 may also include annular isolators, herein illustrated as packers 16, which are positioned intermittently along a lengthwise portion thereof. Regulators 22 and 24 and packers 16 will be described in more detail hereinbelow.

Figure 1:
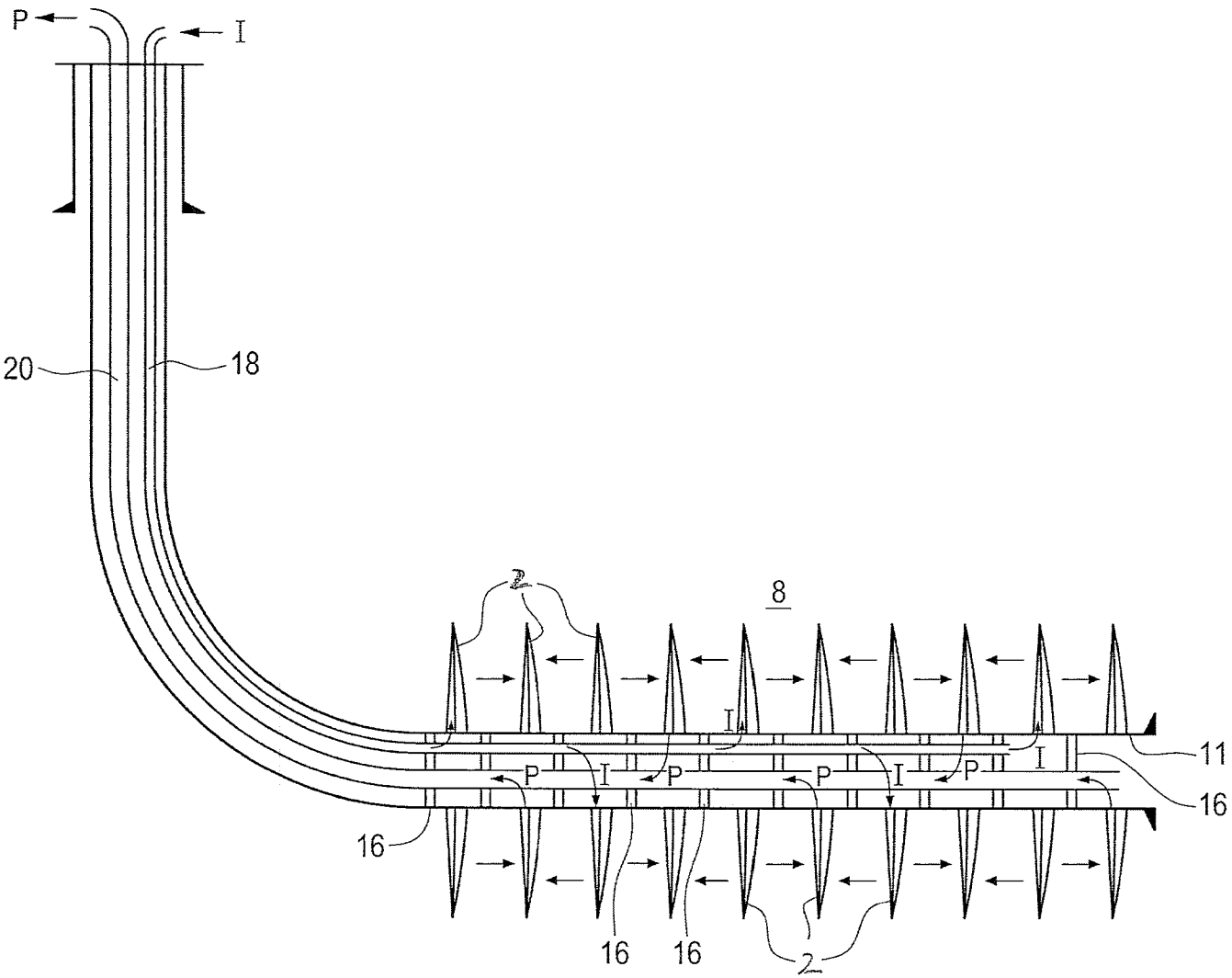
FIG. 1 is a schematic diagram illustrating one embodiment of the invention.
Figure 4:
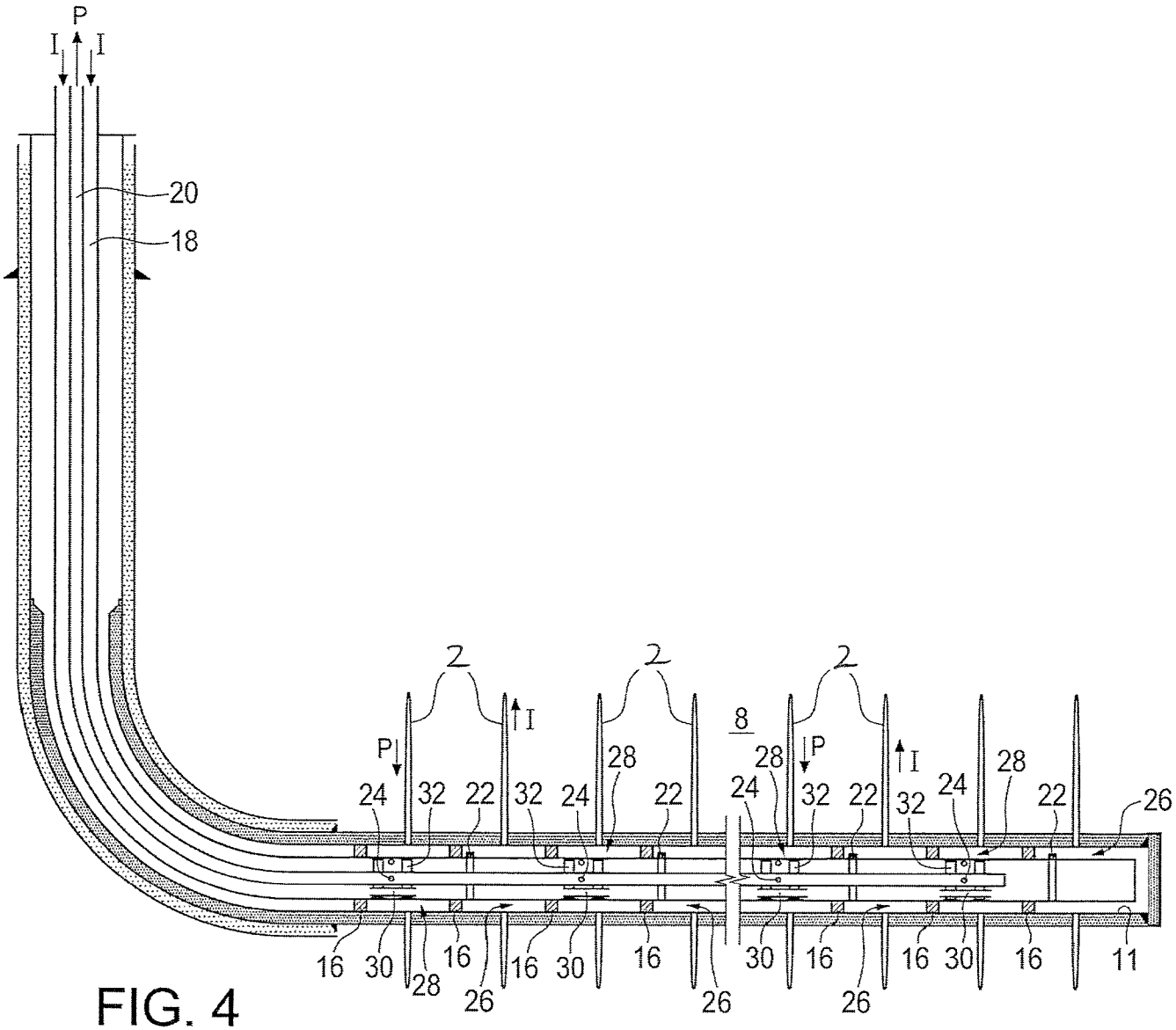
FIG. 4 is a cross-sectional view of yet another embodiment of the invention, where one conduit is inside the other conduit.
Figure 5:
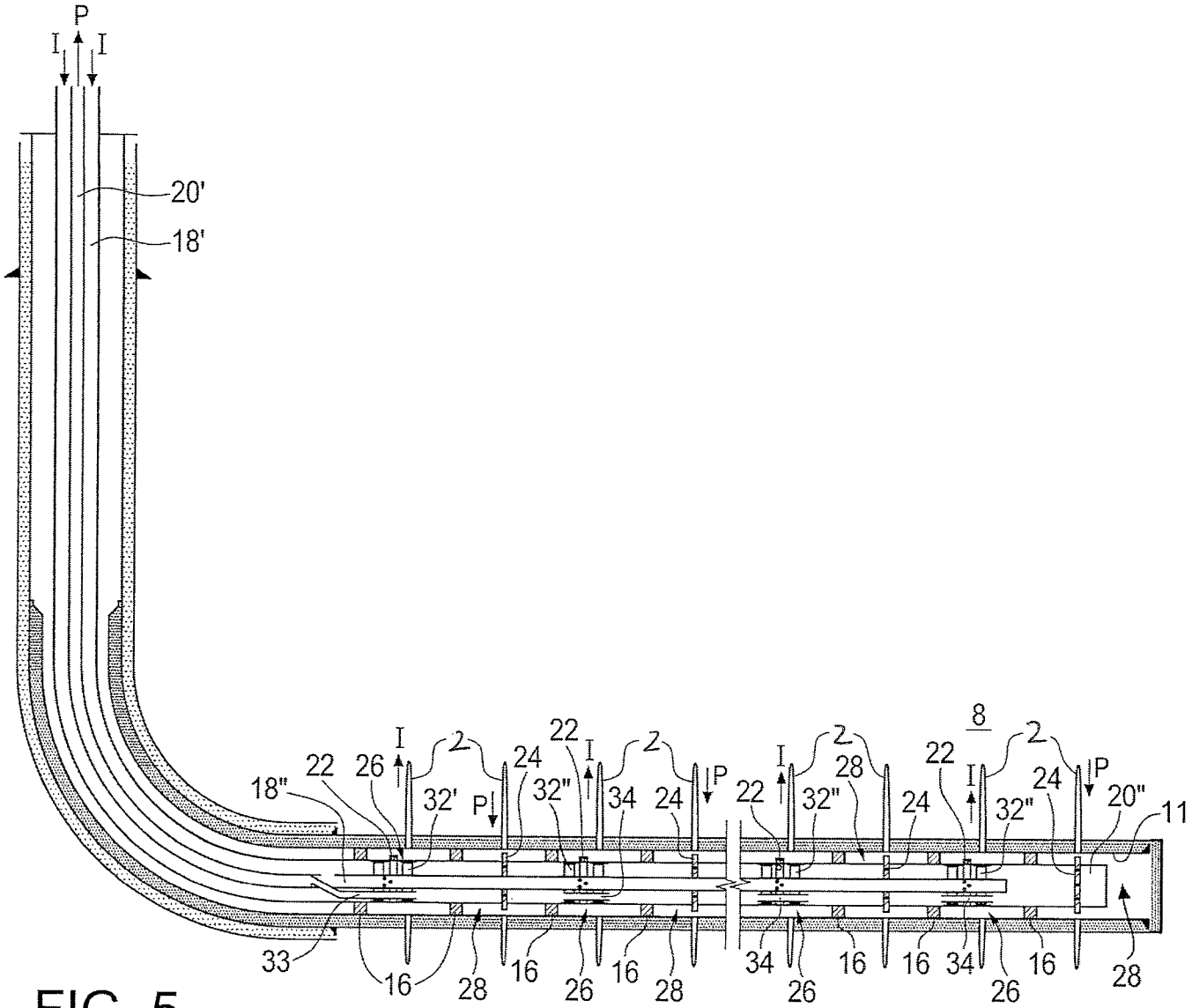
FIG. 5 is a cross-sectional view of another embodiment of the invention, where one conduit is inside the other conduit.
Figure 6:
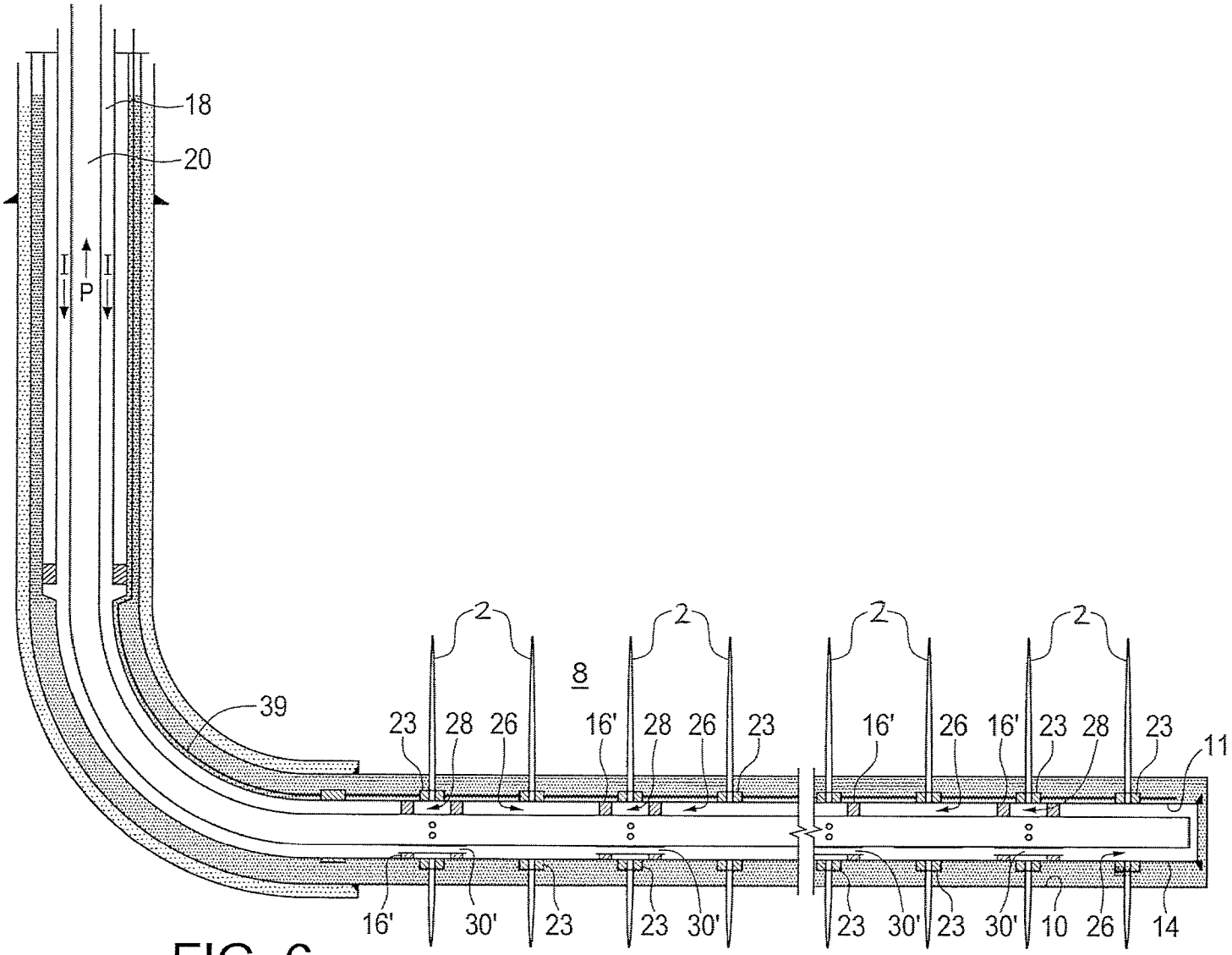
FIG. 6 is a cross-sectional view of still another embodiment of the invention, where one conduit is inside the other conduit.

Injection conduit 18 and production conduit 20 are separate flow channels such that the flow of fluids in one conduit is independent of the other. In one embodiment, as illustrated in FIGS. 1, 2 and 3, injection conduit 18 is positioned side-by-side with and substantially parallel to production conduit 20. In an alternative embodiment, one of the conduits may be inside the other. For example, as shown in FIGS. 4 to 6, the production conduit 20 is placed inside injection conduit 18, and is optionally substantially concentric with injection conduit 18. Further, the position of one conduit relative to the other may vary along the length of the well. For example, as shown in FIG. 5, the production conduit 20' is inside injection conduit 18' above the horizontal section of the well, and the injection conduit 18" becomes the inside conduit along the horizontal section through the use of bypass tubes at or near the heel of the well. However, the conduits are positioned relative to one another, the operation of each of the conduits is independent from one another so the flow of fluids in each conduit can be separately controlled.

In whichever configuration, the diameters of the conduits are sized such that: (i) both conduits can be run into and installed in the same wellbore; (ii) the conduits allow for the flow of either production or injection fluids at suitable flow rates; and (iii) when the conduits are in a desired position downhole, there is at least some space between the wellbore inner surface 11 and the outer surface of at least one of the conduits.

In one embodiment, the production conduit comprises jointed tubing, the length and quantity of which may depend on the measured depth of the well and/or the length of the fractured portion of the well. In a further embodiment, the production conduit is closed at one end (i.e., the lower end) and may have a substantially uniform diameter throughout its length. In another embodiment, the production conduit has a graduated diameter along its length, with the larger diameter portion above the uppermost packer or above a pump, if one is included for transporting the petroleum from the production conduit.

Tubing that meets American Petroleum Institute ("API") standards and specifications ("API tubing") may be used for the production conduit and/or the injection conduit. Proprietary connection tubing and/or tubing that has a smaller outside diameter at the connections than specified by API may also be used. Alternatively, non-API tube sizes may be used for all or a portion of the production conduit and/or the injection conduit.

In a sample embodiment, the production conduit tubing for installation in the fractured section of the well has an outer diameter ranging between about 52.4 mm and about 114.3 mm, preferably with API or proprietary connections and a joint length of approximately 9.6 m, for a well wherein at least a portion of the fractured section is cased, and wherein the casing string has an outer diameter ranging between about 114.3 and about 193.6 mm. In another sample embodiment, a production conduit tubing having the above-mentioned characteristics may also be used in an uncased well, wherein the open-hole diameter in the fractured section ranges between about 155.6 and about 244.5 mm.

In one embodiment, the injection conduit comprises coiled tubing, API jointed tubing, or proprietary tubing. The length and quantity of the injection conduit tubing may depend on the measured depth of the well and/or the length of the fractured portion of the well. In a further embodiment, the injection conduit is closed at one end (i.e. the lower end) and may have a substantially uniform diameter throughout its length. If coiled tubing is used for the injection conduit, the outer diameter of the injection conduit tubing may range from about 19 mm to about 50.8 mm. In a preferred embodiment, the coiled tubing for the injection conduit has an outer diameter of approximately 25.4 mm. If jointed tubing is used for the injection conduit, the outer diameter of the injection conduit tubing may range from about 26.67 mm to about 101.6 mm. In another sample embodiment, a production conduit tubing having the above-mentioned characteristics may also be used in an uncased well, wherein the open-hole diameter in the fractured section ranges between about 155.6 and about 244.5 mm.

In a side-by-side configuration as illustrated in FIGS. 1 to 3, the jointed tubing for the injection conduit, for example, has an outer diameter of approximately 26.67 mm, and the production conduit tubing has an outer diameter of approximately 60.3 mm. In a system configuration wherein one conduit is disposed inside the other, as illustrated in FIGS. 4 to 5, the outer conduit for example has an outer diameter of approximately 101.6 mm and the inner conduit has an outer diameter of approximately 52.4 mm, In another sample system configuration wherein one conduit is placed inside the other as illustrated in FIG. 6, the outer conduit's outside diameter is approximately 114.3 mm and the inner conduit's outer diameter is approximately 60.3 mm.

In one embodiment, both the injection and production conduits along with any downhole sensors, instruments, electric conductor lines and hydraulic control lines are housed inside a single encapsulated cable. The type of encapsulated cable produced by Technip Umbilical Systems may be used but modifications may be required to accommodate packers and valves thereon.

The production conduit is for transporting fluids from the wellbore to the surface of the wellbore opening. The fluids received by the production conduit are referred to as "produced fluids". The injection conduit is for transporting injection fluid from at least the wellbore opening into the wellbore.

Injection fluid (sometimes also referred to as "injectant") includes for example water, gas (e.g., nitrogen, and carbon dioxide), and/or petroleum solvent (e.g., methane, ethane, propane, carbon dioxide, or a mixture thereof), with or without chemical additives. However, any fluid that can become miscible to the petroleum in-situ may be used as the injectant since miscible floods have shown to produce superior hydrocarbon recovery factors over immiscible floods.

The injection fluid may be supplied to the injection conduit from a supply source at surface. Alternatively or additionally, injection fluid may be recovered and separated from the produced fluids, and then compressed and re-injected into the injection conduit. In one embodiment, any or all of the recovering, separating, compressing, and re-injecting of injection fluid may be performed downhole.

In one embodiment, the composition of the injection fluid may be selected based on its solubility in the reservoir petroleum. The process of using a dissolvable injection fluid to sweep reservoir petroleum is sometimes referred to as "hydrocarbon miscible solvent flood," or "HCMF". Examples of hydrocarbon miscible solvents include for example methane, ethane, propane, and carbon dioxide. The dissolution of certain soluble injection fluids into the reservoir petroleum generally lowers the viscosity of the latter and reduces interfacial tension, thereby increasing the mobility of the petroleum within the reservoir. This process may improve the rate of production and increase the recovery factor of petroleum recoverable from the reservoir.

Annular isolators, such as packers (also called seals) or cement, are usually used to divide the wellbore annulus between the conduits and the wellbore wall into fluid-sealed sections. Annular isolators prevent fluid from flowing through the annulus from an injection zone to a production zone, which instead forces the injected fluid to pass into and through the formation. In this illustrated embodiment, packers 16 are employed. Packers are usually carried downhole with or as a component of a downhole tool. Packers 16 may include various types of mechanisms, such as swellable rubber packer elements, mechanical set packer elements and slips, cups, hydraulic set mechanical packer elements and slips, inflatable packer elements, seal bore/seal combination, or a combination thereof.

Packers are often selectively expandable, being generally transformable from a retracted position (sometimes also referred to as a "running position") to an expanded position (sometimes also referred to as a "set position"). The packers are in the retracted position when the downhole tool is run into the wellbore, such that the packers do not engage the inner surface of the wellbore to cause interference during the running in. Once the downhole tool is positioned at a desired location in the wellbore, the packers are converted to the expanded position. In the expanded position, the packers engage the wellbore wall if the well is uncased or the casing string if the well is cased (collectively referred to herein as the "wellbore inner surface") and may function to fluidly seal the annulus between the downhole tool and the wellbore inner surface, and may also function to anchor the downhole tool (or a tubing string connected thereto) to the wellbore inner surface.

In one embodiment, as shown for example in FIGS. 1 to 3, packers 16 are connected to both conduits. In the sample embodiments shown in FIGS. 4 to 6, packers 16 are connected to one of the conduits. Packers 16 may be connected to one or both of the conduits in various ways, including for example, by threaded connection, friction fitting, bonding, welding, adhesives, etc. In one embodiment, packers 16 are configured to be expandable from the outer surface of at least one of the conduits. The packers are spaced apart along the length of the conduits such that adjacent flow regulators 22 and 24 are separated by at least one packer. Alternatively or additionally, adjacent packers may have one or more injection flow regulators 22 or production flow regulators 24 positioned therebetween.

In a preferred embodiment, packers 16 are mechanical feedthrough-type packers having a hydraulic-setting mechanism. Generally, feedthrough-type packers allow the passage of conduit(s), electrical conductor line(s), and/or communication line(s) therethrough. In a further preferred embodiment, packers 16 are feedthrough-type swellable packers (sometimes also referred to as cable swellable packers) that allow at least one of the conduits to connect thereto and extend therethrough. In one embodiment, the packers are attached in the retracted position to the production conduit pre-run in and are expanded after the conduits are at a desired location downhole. In the expanded position, the packers engage the wellbore and fill a portion of the annulus between the inner surface of the wellbore and the outer surfaces of the conduits. In one embodiment, packers 16 are configured to expand radially outwardly from the outer surfaces of the conduits. Once expanded, each packer creates a seal with the wellbore inner surface such that fluid can only flow from one side of the packer to the other side through the conduits or through the formation.

In a sample embodiment, one or more of the packers may be manufactured on or connected to a section of tubing, which may range from about 3 m to about 9.6 m in length, and the tubing having a packer thereon is connected at both ends to production conduit tubings. In a further embodiment, the packer has a length ranging from about 1 m to about 5 m. The connection between the packer tubing and the production conduit tubing may be an API specification or proprietary design threaded connection. In a sample embodiment, packers 16 are made of an elastomeric polymer bladder that is inflatable upon injection of a fluid therein. The types of fluid that may be used to inflate the packers include for example oil and water.

Preferably, packers 16 are positioned in between fractures or perforations 13 (if the well is cased). The locations of the fractures may be determined by the location of the perforations in the casing according to the executed completion plan, or by microseismic monitoring or logging. Logging methods may include radioactive tracer, temperature survey, fiber optic distributed temperature sensor survey, or production logging. Generally, adjacent hydraulic fractures are spaced apart by approximately 100 m, but sometimes the distance between adjacent hydraulic fractures in a horizontal well may range from about 20 to about 200 m. In one embodiment, packers 16 are positioned in the wellbore such that there are one or more fractures between adjacent packers. It is not necessary that the packers 16 are evenly spaced along the horizontal section of the well. The distance between adjacent packers may vary.

Preferably, each packer 16 creates a seal with the wellbore inner surface 11 such that fluid can only flow from one side of the packer to the other side through one of the conduits. The space defined by the wellbore inner surface 11 and the outer surface of one or both of the conduits, in between two adjacent packers, and in communication with at least one fracture, is referred to hereinafter as a "zone." Adjacent zones are fluidly sealed from one another. Preferably, each zone permits the flow of fluids thereto from one or more fractures 2 and/or from the injection conduit 18.

Referring to FIGS. 2 to 5, flow regulators 22 of the injection conduit allow selective introduction of injection fluid from the conduit into the wellbore. More specifically, flow regulators 22 help distribute and control the flow of injection fluid into selected zones. Preferably, the flow regulator 22 has at least an open position and a closed position. In the open position, the regulator 22 allows fluid flow therethrough. In the closed position, the regulator 22 blocks fluid flow. The open position may include one or more partially open positions, including choked, screened, etc., such that the rate of fluid flow therethrough may be selectively controlled.

A number of devices may be used for flow regulators 22, including for example sliding sleeves, tubing valves, chokes, remotely operated valves, and interval control valves. Remotely operated valves are valves that can be hydraulically, electrically, or otherwise controlled from a downhole location and/or the surface of the well opening. However, other devices that function in a similar manner as the aforementioned examples may also be used. In one embodiment, flow regulators 22 are controllable with radio-frequency identification ("RFID").

In a sample embodiment, the injection flow regulators 22 are chokes, each with a throat diameter configured to generate sufficient pressure resistance to limit the rate at which injection fluid is supplied to the injection zone downstream of the flow regulator, thereby distributing the injection fluid in a controlled manner. The chokes may be incorporated into valves to allow "choking" to help control the distribution of the injection fluid when the valves are in an open position. In a preferred embodiment, the injection flow regulator 22 also comprises a mechanism (for example, a sliding sleeve) that can be selectively closed to prevent substantially all fluid from flowing therethrough.

In the sample embodiments shown in FIGS. 2 to 5, there is an injection flow regulator in every other zone, thereby allowing fluid communication between these zones and the injection conduit through the injection flow regulator. A zone that can receive injection fluids from the injection conduit (for example, through an injection flow regulator) is referred to as an "injection zone".

Referring to FIGS. 2 to 5, flow regulators 24 of the production conduit allow selective intake of petroleum and/or other fluids from the formation to the production conduit. Preferably, flow regulators 24 control when fluids can flow into and/or the types of fluids that can flow into the production conduit. In one embodiment, the flow regulator 24 has at least an open position and a closed position. In the open position, the regulator 24 allows fluid flow therethrough. In the closed position, the regulator 24 blocks fluid flow. The open position may include one or more partially open positions, including choked, screened, etc., such that the rate of fluid flow therethrough may be selectively controlled.

Additionally or alternatively, the flow regulators 24 may be configured to have a customized fluid flow path that selectively allows the passage of fluids based on viscosity, density, fluid phase, or a combination of these properties. In one embodiment, the flow regulator 24 restricts the flow of fluids having a lower viscosity and/or density than the desired petroleum such that fluids with a viscosity and/or density similar to the desired petroleum flow through the regulator 24 preferentially and into the production conduit. Flow regulators 24 may therefore restrict undesirable fluids (e.g., water, and gas, such as for example methane, ethane, carbon dioxide, and propane) from flowing into the production conduit. In a preferred embodiment, flow regulators 24 allow the flow of liquid petroleum therethrough while limiting the passage of undesired gas and/or water.

Any device that can selectively allow and/or restrict the flow of certain fluids therethrough may be used for flow regulators 24, including for example orifice style chokes, tubes, sliding sleeve valves, remotely operated valves, and autonomously functioning flow control devices. Other devices that function in a similar manner as the aforementioned examples may also be used. In one embodiment, flow regulators 24 are controllable with radio-frequency identification ("RFID").

In a sample embodiment, the production flow regulators 24 are autonomously functioning flow regulators, which are self-adjusting in-flow control devices, whereby fluid flow is autonomously controlled in response to changes in a fluid flow characteristic, such as density or viscosity. Autonomously functioning flow regulators are sometimes more commonly referred to as Autonomous Inflow Control Device ("AICD"). The AICD has two main functions: one is to identify the fluid based on its viscosity, and the second is to restrict the flow when undesirable fluids are present.

Both of these functions are created by specially designed flow channels inside the device.

AICDs generally utilize dynamic fluid technology to differentiate between fluids flowing therethrough. For example, an AICD may be configured to restrict the production of unwanted water and gas at breakthrough to minimize water and gas cuts. Generally, AICDs have no moving parts, do not require downhole orientation, and utilize the dynamic properties of the fluid to direct flow. AICDs may work by directing fluids through different flow paths within the device. Higher viscosity oil takes a short, direct path through the device with lower pressure differential. Water and gas spin at high velocities before flowing through the device, creating a large pressure differential.

Preferably, the AICD chokes low viscosity (undesired) fluids, thereby significantly slowing flow from the zone producing the undesirable fluids. This autonomous function enables the well to continue producing the desired hydrocarbons for a longer time, which may help maximize total production.

In another sample embodiment, the production flow regulators 24 are valves that can be remotely opened and closed, such as for example intelligent well completion valves, which allow the selective ceasing of petroleum flow into the production conduit from one or more production zones. By closing the flow regulators 24 of one or more production zones for a certain period of time, the injection fluid is allowed to penetrate deeper into the reservoir which may help increase petroleum production. In a further embodiment, selected production flow regulators 24 are closed while the remaining regulators are opened to allow production of petroleum, and the pattern or sequence of which regulators are opened or closed at any given time may be configured as required to optimize the performance of the system.

In the sample embodiments shown in FIGS. 2 to 5, there is a production flow regulator 24 in each of the zones adjacent to the injection zones, thereby allowing each adjacent zone to fluidly communicate with the production conduit via the production flow regulator. The zones in which petroleum and/or other reservoir fluids can be collected therefrom (for example, by a production conduit via a flow regulator 24) are referred to herein as "production zones".

In one embodiment, injection flow regulators 22 are connected to the injection conduit and/or production flow regulators 24 are connected to the production conduit. This may be achieved in various ways. For example, the flow regulators may be manufactured into tools that have a similar outer diameter as the conduit and are insertable at almost any position along the length of the conduit by, for example, cutting the tubing of the conduit at a desired location and inserting and connecting the flow regulator tool at the cut. The tool may be connected to the tubing by for example mechanical connection, threaded connection, adhesives, bonding, welding, etc. Mechanical connections include for example the use of external crimps and external compression sleeves. External crimps may be used to create a seal between the flow regulator tool and the conduit tubing by plastically deforming the tubing on to the tool. External compression sleeves may be used to seal the outer surface of the tubing at and near the cut. In one embodiment, the flow regulators are made of metal, such as steel, that can withstand wellbore conditions. In a further embodiment, where the flow regulators are chokes, the throat is made of an erosion wear resistant material, including for example tungsten carbide or matrix material containing tungsten carbide, ceramic, or an erosion wear resistant carbon nanostructure.

There are many ways to configure the system of the present invention, for example, by varying the placement and/or location of one or more of the production conduit, injection conduit, packers, production flow regulators, and injection flow regulators. In a sample embodiment, as illustrated in FIGS. 2 to 5, the injection flow regulators 22 and production flow regulators 24 are offset laterally along the length of the conduits such that regulators 22 are not aligned with regulators 24, and adjacent injection flow regulators and production flow regulators are separated by a packer 16. Of course, other configurations are possible.

Further, the number of injection zones 26 and production zones 28 in the system may be selectively varied and may depend on the characteristics of the well, including for example the number of fractures in the well. Each zone may be in communication with one or more hydraulic fractures. Alternatively, there may be as many injection and production zones in total as the number of hydraulic fractures, but not necessarily. Preferably, the lower end of the production conduit is in communication with the lowermost (i.e., farthest away from the well opening) production zone via a production flow regulator 24. Further, the lower end of the injection conduit is preferably in communication with the lowermost injection zone via an injection flow regulator 22.

The pattern of alternating injection and production zones may be a regular periodic pattern or an irregular random pattern along the length of the horizontal section of the well. Consecutive production zones may be separated by one or more injection zones, and vice versa. For example, in one configuration, a first injection zone is separated from a second injection zone by one production zone, and the second injection zone is separated from a third injection zone by three production zones, and the third injection zone is separated from a fourth injection zone by two production zones.

In one embodiment, at least one production zone may also function as an injection zone, and vice versa. This may be accomplished, for example, by: (i) using flow regulators that can function as both injection flow regulators and production flow regulators; and/or (ii) using independently functioning injection flow regulators and production flow regulators within the same zone. In a further embodiment, all zones are configured to allow selective injection of fluid into the reservoir.

In another sample embodiment, the production and injection conduits are set up as shown in FIGS. 2 to 5, wherein the zones alternate between injection zones and production zones along the length of the horizontal section. The flow regulators 22, in the open position, allow injection fluid to flow from the injection conduit into the injection zones 26 and into the fractures that are in communication with the injection zones. In the illustrated embodiments, the general flow direction of the injection fluid is indicated with arrows "I".

Production flow regulators 24 allow petroleum and/or other fluids in production zones 28 to flow into the production conduit, which may then flow to or be pumped to surface and be collected. In the illustrated embodiments, the general flow direction of the produced fluid is denoted by arrows "P". Various methods may be employed to transport the petroleum in the production conduit to surface, including for example by way of an electric submersible pump, reciprocating subsurface pump, progressing cavity pump, gas lift, etc. or a combination thereof.

As discussed above, flow regulators 24 may be configured to restrict the flow of fluids other than reservoir petroleum into the production conduit. Some injection fluid may flow into production zones in the gaseous phase as the reservoir is being emptied of liquid petroleum, and flow regulators 24 may prevent most or all of such injection fluid from entering the production conduit. For example, if the flow regulator 24 is a choking or autonomous choking valve type flow regulator, the flow regulator may prevent most low viscosity fluid from entering the production conduit. However, if the flow regulator 24 is a surface or downhole actuated valve, such as a sliding sleeve, the flow regulator may prevent all fluids from entering the production conduit when the flow regulator is in the closed position. In a preferred embodiment, the production flow regulator 24 includes a mechanism (for example, a sliding sleeve) that can be selectively closed to prevent substantially all fluid from flowing therethrough.

There are situations where it may be desirable to include a production flow regulator 24 that, when closed, can prevent substantially all fluids from entering the production conduit in the production zone. For instance, if the well is poorly cemented such that almost all injection fluid entering a particular injection zone travels directly from the injection zone to an adjacent production zone rather than to the reservoir (this event is sometimes referred to as "short circuiting" of injection fluid), it would be desirable to have a surface or downhole actuated valve type flow regulator in the adjacent production zone to allow that production zone to be substantially completely shut off from the production conduit when the flow regulator therein is in the closed position. Shutting off the affected production zones in this manner may help reduce the effect of short circuiting, thereby encouraging the injection fluid to flow into the reservoir.

Another situation where it may be desirable to use surface or downhole actuated valve type flow regulators in production zones to allow the selective shutting off of certain production zones is when there is massive reservoir heterogeneity within a single horizontal well, which may be due to permeability variation or to natural fracture or complex hydraulic fracture swarms locally concentrated within only a part of the wellbore affected reservoir. In this situation, temporarily shutting off certain production zone(s), while continuing to inject fluid into injection zone(s), may cause the injected fluid to enter the reservoir more deeply and saturate the nearby reservoir fluid and/or cause the reservoir pressure to increase locally. Reopening the shut off production zone(s) after a period of time may cause any injectant-affected reservoir fluid to drain into production zones, which may in turn improve petroleum production. This method of temporarily shutting off one or more production zones and reopening same may be useful in the middle and/or later life of the well.

In embodiments where one conduit is placed inside the other, as shown for example in FIGS. 4 to 6, the system may comprise additional or different components and/or may be configured differently. Referring to FIG. 4, production conduit 20 extends axially along the length of the inner bore of injection conduit 18. Packers 16 are intermittently positioned on the outer surface and along the length of the injection conduit 18 in the horizontal section of the well to fluidly seal the annulus between the wellbore inner surface and conduit 18 to define zones, as discussed above. At various locations along the length of both conduits, seals 32 are provided to: (i) fluidly seal off a portion of the annulus between the outer surface of conduit 20 and the inner surface of conduit 18; and (ii) allow production conduit 20 to communicate with certain zones. Seals 32 are configured to have production conduit 20 passing therethrough.

In one embodiment, each seal 32 has a first end, a second end, and a space is provided therebetween. Seal 32 is positioned and installed relative to the production conduit 20 such that at least one production flow regulator 24 is situated in the space of the seal. Further, at least one opening is provided in the injection conduit and the opening is in communication with the space of seal 32. The at least one opening in the injection conduit is preferably positioned axially between a pair of packers 16, and thus defining a production zone 28 in the annulus between the wellbore inner surface 11 and the outer surface of the injection conduit and the pair of packers. The opening in the injection conduit allows the passage of fluids between the space in seal 32 and the zone.

Since flow regulator 24 is situated in the space of the seal, when it is in an open position, it is in fluid communication with the space of the seal and in turn the production zone 28. Seal 32 provides a fluid seal in the annulus between the conduits, thereby preventing any fluid in the injection conduit from entering the space in the seal. Therefore, each seal 32 allows fluid communication between the production zone and the production conduit 20, when flow regulator 24 is open, while preventing fluid communication between the injection conduit and the production zone.

The system further comprises injection bypass tubes 30 to allow passage of fluid in the injection conduit through the seals 32, while bypassing (i.e., being fluidly sealed from) production zones. In a sample embodiment, the bypass tube 30 extends between the first and second ends through each seal 32, allowing fluid communication between the annuli adjacent to the first and second ends while bypassing the space in seal 32. Bypass tubes 30 thereby fluidly connect sections of the injection conduit that are separated by seals 32 along the length of the horizontal section, while bypassing production zones.

Accordingly, injection flow regulators 22 of the injection conduit are situated in the zones that are not in communication with the production conduit (i.e., zones without seals 32 positioned therein). Injection fluid can flow past seals 32 to each flow regulator 22 along the length of the injection conduit via bypass tubes 30.

Seal 32 and injection bypass tube 30, together, allow fluid communication between the production zone and the production conduit, while allowing injection conduit fluid to bypass the production zone.

In another embodiment, the positions of the injection and production conduits may be reversed, such that the injection conduit runs inside the production conduit. In this embodiment, the fluid flow in each conduit can also fluidly communicate with certain zones separately and independently from the other conduit, through the use of seals 32 and injection bypass tubes 30 as described above.

Referring to FIG. 5, the production conduit has an upper portion 20' and a lower portion 20". The injection conduit also has an upper portion 18' and a lower portion 18". The relative position of the upper portions of the conduits to each other may be different than the relative position of the lower portions down the length of the well. For example, the production conduit may be inside the injection conduit in the upper portion, while the production conduit houses the injection conduit therein in the lower portion.

In a sample embodiment shown in FIG. 5, the upper portion 20' of the production conduit extends axially inside the length of the inner bore of the upper portion 18' of the injection conduit in the substantially vertical section and the heel of the well. Below the heel, in the substantially horizontal section, the lower portion 18' of the injection conduit runs axially inside the lower portion 20' of the production conduit. In other words, the production conduit is the inner conduit in an upper part of the well and it is the outer conduit in a lower part of the well.

In the illustrated embodiment, the upper portion 20' and lower portion 20" of the production conduit are connected by a transition bypass tube 33, through which the upper portion 20' and lower portion 20" are in fluid communication.

Packers 16 are intermittently positioned on the outer surface and along the length of the lower portion 20" of the production conduit to fluidly seal the annulus between the wellbore inner surface and the outer surface of the production conduit to define zones, as discussed above.

At various locations along the length of both conduits 18" and 20" in the horizontal section, seals 32', 32" are provided to: (i) fluidly seal off a portion of the annulus between the outer surface of conduit 18" and the inner surface of conduit 20"; (ii) allow the lower portion 18" of the injection conduit to communicate with certain zones. Seals 32', 32" are configured to have the lower portion 18" of the injection conduit passing therethrough.

In one embodiment, each seal 32', 32" has a first end, a second end, and a space is provided therebetween. Seal 32', 32" is positioned and installed relative to the lower portion 18" of the injection conduit such that at least one injection flow regulator 22 is situated in the space of the seal. Further, at least one opening is provided in the lower portion 20" of the production conduit and the opening is in communication with the space of seal 32', 32". The at least one opening in the lower portion 20" is preferably positioned axially between a pair of packers 16, and thus defining an injection zone 26 in the annulus between the wellbore inner surface 11 and the outer surface of the lower portion 20" and the pair of packers. The opening in the lower portion 20" of the production conduit allows the passage of fluids between the space of seal 32', 32" and the injection zone.

Since flow regulator 22 is situated in the space of the seal, when it is in an open position, it is in fluid communication with the space of the seal and in turn the injection zone 26. Seal 32', 32" provides a fluid seal in the annulus between the conduits, thereby preventing any fluid in the lower portion 20" of the production conduit from entering the space in the seal 32', 32". Therefore, each seal 32', 32" allows fluid communication between the injection zone and the lower portion 18" of the injection conduit, when flow regulator 22 is open, while preventing fluid communication between the lower portion 20" of production conduit and the injection zone.

In order to transition from the upper portions 18' and 20' to the lower portions 18" and 20" of the conduits, transition bypass tube 33 fluidly connects the upper portion 20' and the lower portion 20" of the production conduit, to transition the production conduit from being the inner conduit to being the outer conduit. In one embodiment, transition bypass tube 33 allows passage of fluid in the production conduit through the uppermost seal 32', while bypassing the uppermost injection zone. In a sample embodiment, the bypass tube 33 extends between the first and second ends through the uppermost seal 32', allowing fluid communication between the spaces adjacent to the first and second ends while bypassing the space in the uppermost seal 32'. The upper end of bypass tube 33 is in communication with the upper portion 20' of the production conduit (i.e., the inner conduit) and the lower end of bypass tube 33 is in communication with the lower portion 20" (i.e., the outer conduit), thereby transitioning the production conduit through the uppermost seal 32'.

The upper portion 18' of the injection conduit is in fluid communication with the lower portion 18", for example via an opening in the lower portion 18" at or near the first end of the uppermost seal 32', above the seal 32'.

Below the uppermost seal 32', the system further comprises production bypass tubes 34 to allow passage of fluid in the lower portion 20" of the production conduit through the seals 32", while bypassing injection zones. In one embodiment, the bypass tube 34 extends between the first and second ends through each seal 32", allowing fluid communication between the annuli adjacent to the first and second ends while bypassing the space in seal 32". Bypass tubes 34 thereby fluidly connect sections of the production conduit that are separated by seals 32" along the length of the horizontal section.

Accordingly, production flow regulators 24 of the production conduit are situated in the zones that are not in communication with the injection conduit (i.e., zones without seals 32', 32" positioned therein). Fluids from the reservoir can enter the production conduit via each flow regulator 24 and flow up the production conduit through seals 32', 32" via bypass tubes 33 and 34.

Seal 32', 32" and bypass tube 33, 34, together, allow fluid communication between the injection zone and the injection conduit, while allowing production conduit fluid to bypass the injection zone. The conduits are transitioned using transition bypass tube 33 and uppermost seal 32', and are maintained using production bypass tubes 34 and seals 32", such that fluid flow in upper portion 20' and lower portion 20" of the production conduit is separated from fluid flow in upper portion 18' and lower portion 18" of the injection conduit throughout the length of the well.

In another embodiment, the positions of the injection and production conduits may be reversed, such that the upper portion of the injection conduit runs inside the upper portion of the production conduit and the lower portion of the production conduit runs inside the lower portion of the injection conduit. In this embodiment, the fluid flow in each conduit can also fluidly communicate with certain zones separately and independently from the other conduit, through the use of seals 32', 32" and bypass tubes 33 and 34 as described above.

In another sample embodiment, as shown in FIG. 6, a cased well includes casing 14 which is cemented to wellbore wall 10 in at least the horizontal section. Casing 14 may have a larger diameter segment above the heel of the well that extends to surface, and an uncemented tubing is placed in the larger diameter segment. The wellbore inner surface 11 in the horizontal section is the inner surface of casing 14 in the horizontal section. In this embodiment, rather than providing a separate tubing for injection conduit 18, injection conduit 18 is defined by the space between the wellbore inner surface 11 and the outer surface of the production conduit 20. Instead of injection flow regulators and production flow regulators, a plurality of casing flow regulators 23 are provided at or near the outer surface of casing 14, intermittently positioned along the length of the horizontal section of the well. Each of the flow regulators 23 is in communication with at least one fracture 2 in the formation 8.

In one embodiment, casing flow regulators 23 function as both hydraulic fracture diversion valves and as injection flow regulators (as described above) or production flow regulators (as described above). Each casing flow regulator may be remotely and/or independently operated. Each casing flow regulator has an open position and a closed position, and the open position may include one or more partially open positions (e.g., screened, choked, etc.). In the open position, the casing flow regulator 23 permits communication between the horizontal section of the wellbore and the fracture through a perforation in casing 14. In the closed position, casing flow regulator 23 blocks fluid flow therethrough.

Production conduit 20 extends axially along the length of the inner bore of injection conduit 18, which is in the horizontal section of the wellbore defined by wellbore inner surface 11. Packers 16' are intermittently positioned on the outer surface and at positions along the length of the production conduit 20 in the horizontal section of the well to fluidly seal the annulus between the wellbore inner surface and conduit 20 to define zones, as discussed above. In this embodiment, packers 16' are also provided to allow production conduit 20 to communicate with certain zones, while allowing fluid in the injection conduit 18 to bypass these zones.

In one embodiment, each packer 16' has a first end packer, a second end packer. The end packers are separated by a space therebetween. Packer 16' is positioned and expanded (i.e., installed) relative to casing 14 in the horizontal section such that at least one casing flow regulator 23 is situated in the space in between the end packers of the packer 16'. The at least one casing flow regulator 23 therefore allows fluid communication between the fracture(s) connected thereto and the space in packer 16', when the casing flow regulator is in an open position.

Further, at least one opening is provided in the production conduit 20 and the at least one opening is in fluid communication with the space of packer 16'. Thus, the space in packer 16' defines a production zone 28, in which reservoir fluids may be collected when the at least one casing flow regulator 23 in the production zone is open or partially open. Any fluid collected in the production zone 28 can flow into the production conduit 20 through the at least one opening therein. Packer 16' provides a fluid seal in the annulus between the conduits, thereby preventing any fluid in the injection conduit from entering the production zone. Therefore, each packer 16' allows fluid communication between at least one fracture and the production conduit 20, when the casing flow regulator in the production zone is open or partially open, while preventing fluid communication between the injection conduit and the production zone.

Packers 16' are also spaced apart along the production conduit 20, and positioned and expanded relative to casing 14 in the horizontal section, such that at least one casing flow regulator 23 is situated between at least a pair of adjacent packers 16', thereby defining an injection zone 26 between the pair of packers 16' with which at least one fracture can fluidly communicate through the at least one casing flow regulator 23 when the regulator is open or partially open.

The system further comprises injection bypass tubes 30' to allow passage of fluid in the injection conduit between injection zones 26 through the packers 16', while bypassing (i.e., being fluidly sealed from) production zones 28. In one embodiment, the bypass tube 30' extends between the first and second ends through each packer 16', allowing fluid communication between the injection zone adjacent to the first end packer and the injection zone adjacent the second end packer while bypassing the production zone in packer 16'. Bypass tubes 30' thereby fluidly connect sections of the injection conduit that are separated by packers 16' along the length of the horizontal section.

Packers 16' and injection bypass tube 30', together, allow fluid communication between the production zone and the production conduit, while allowing injection conduit fluid to bypass the production zone.

In another embodiment, the positions of the injection and production conduits may be reversed, such that the injection conduit runs inside the production conduit. In this embodiment, the fluid flow in each conduit can also fluidly communicate with certain zones separately and independently from the other conduit, through the use of packers 16' and injection bypass tubes 30' as described above.

Figure 10B:
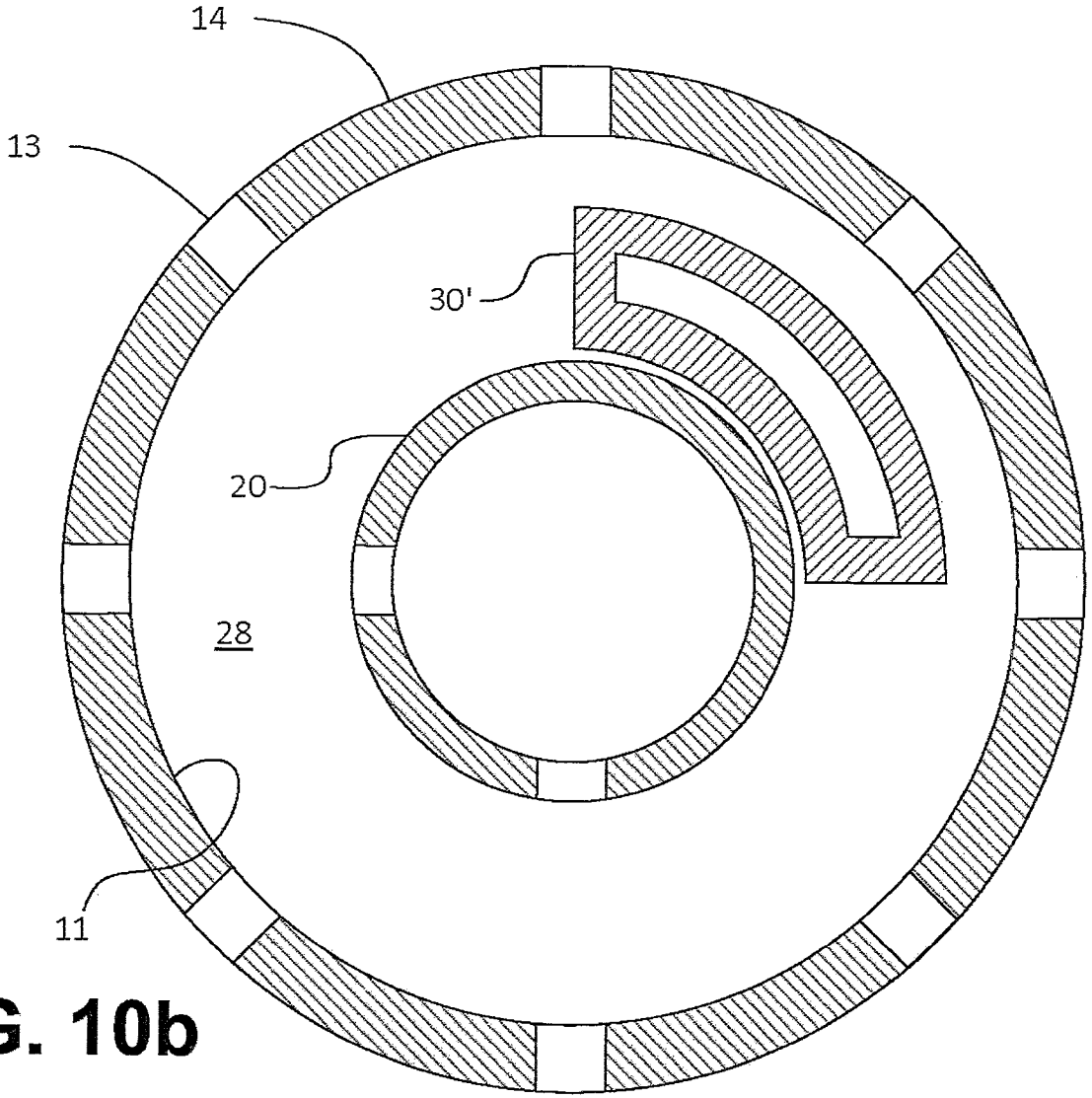
FIGS. 10*a* and 10*b* are a perspective view and a cross-section view, respectively, showing an embodiment of a bypass tube usable with the present invention.
Figure 10A:
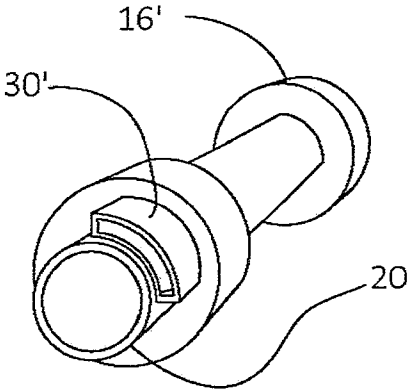

In one embodiment, any of the above-discussed bypass tubes with reference to FIGS. 4 to 6 may be a non-circular tube. For example, the injection bypass tube may have a rectangular cross-section. Other cross-sectional shapes are possible. Referring to the sample embodiment shown FIGS. 6, 10*a* and 10*b*, the injection bypass tube 30' is has an arc-shaped cross-section, and the bypass tube has substantially concentric inner and outer arc segment shaped walls with different radii. The inner and outer arc segment shaped walls are connected at the lengthwise sides by flat walls. In this sample embodiment, the bypass tube 30' is disposed outside the production conduit and extends axially through the production zone 28.

Figure 11B:
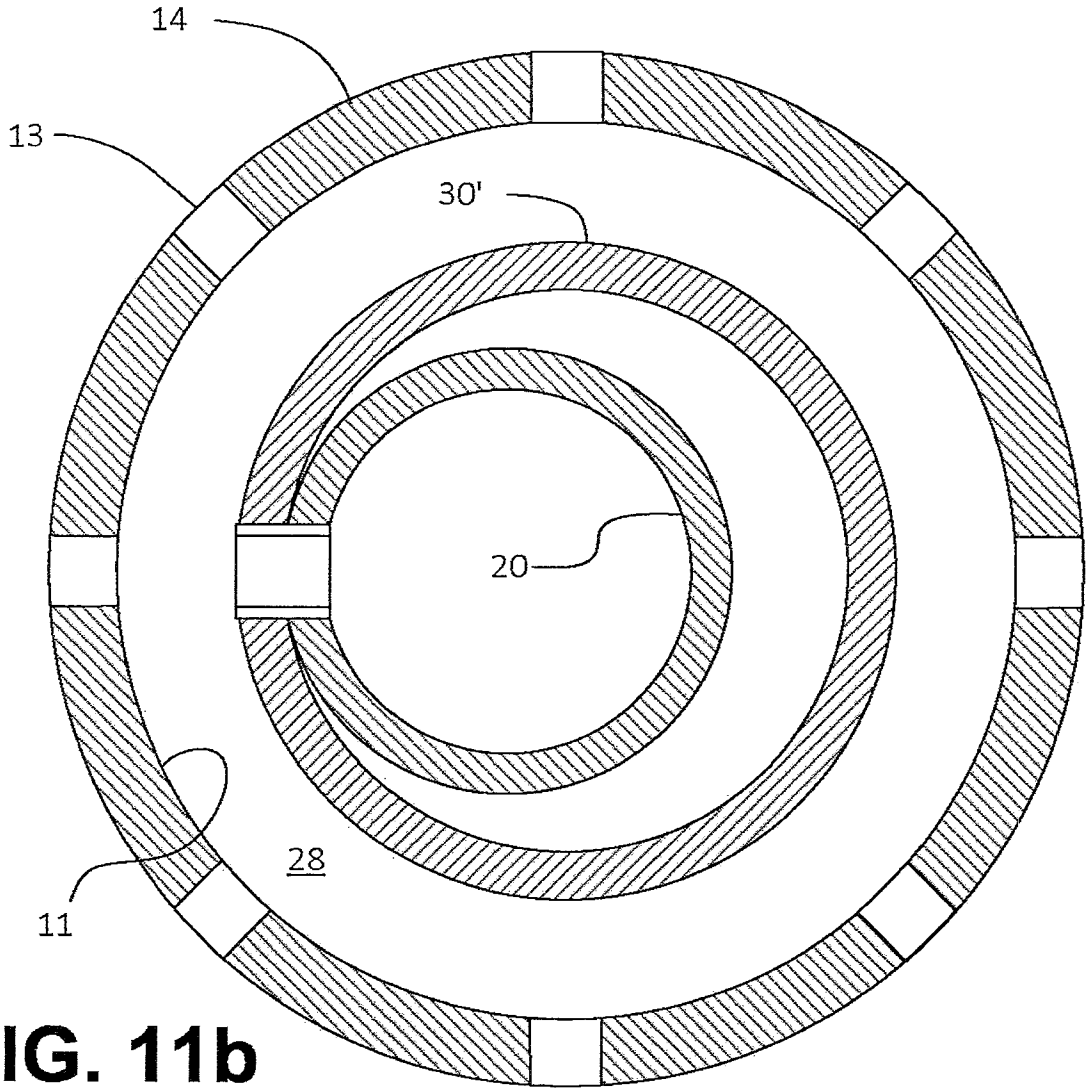
FIGS. 11*a* and 11*b* are a perspective view and a cross-section view, respectively, showing another embodiment of a bypass tube usable with the present invention.
Figure 11A:
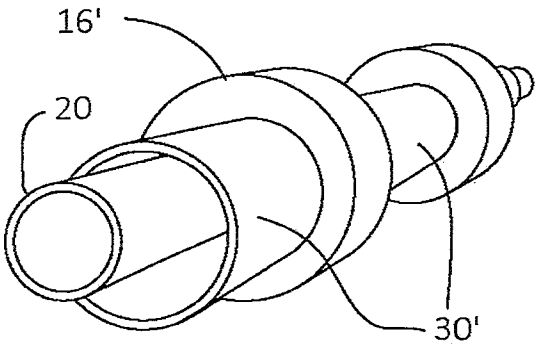

Referring to FIGS. 6, 11*a*, and 11*b*, another sample embodiment is shown wherein the bypass tube 30' is disposed eccentrically outside the production conduit 20 and surrounds a lengthwise portion of the production conduit. In this embodiment, a portion of the outer surface of the production conduit 20 is in contact with the inner surface of the bypass tube 30'. An opening extends between the inner surface of the production conduit and the outer surface of the bypass tube, thereby allowing fluid communication between the inside of the production conduit and the production zone 28. In this sample embodiment, the effective cross-sectional shape of the bypass tube is the crescent shape of the space defined by the outer surface of the production conduit and the inner surface of the bypass tube where the two tubes are not in contact.

Figure 8:
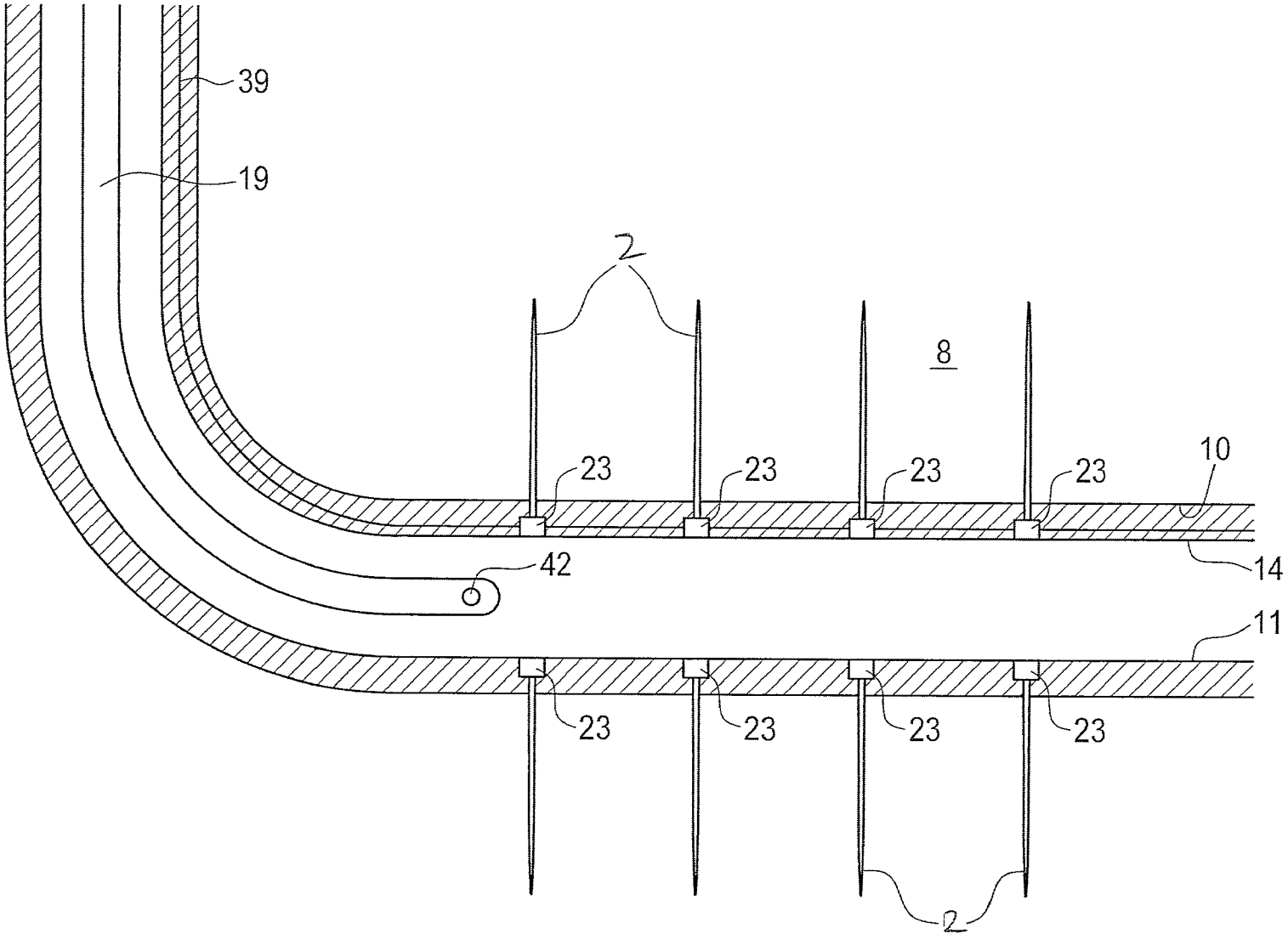
FIG. 8 is a cross-sectional view of another embodiment of the invention, where one conduit is used for both injection and production.

FIG. 8 illustrates another sample embodiment for use with a cased well having a casing 14 which is cemented to wellbore wall 10 in at least the horizontal section. The wellbore inner surface 11 is the inner surface of casing 14. In this embodiment, rather than having two separate tubings for injection and production, one conduit 19 is provided for transporting both injection fluid and reservoir fluid therein. Therefore, in this embodiment, the injection conduit and the production conduit are one and the same. Conduit 19 extends down the well through the heel to near or past the beginning of the horizontal section.

Further, instead of injection flow regulators and production flow regulators, a plurality of casing flow regulators 23 are provided at or near the outer surface of casing 14, intermittently positioned along the length of the horizontal section of the well. Each of the flow regulators 23 is in communication with at least one fracture 2 in the formation 8.

Conduit 19 has at least one opening 42 at or near its lower end for passage of fluids therethrough, thereby allowing fluid communication between the conduit and the wellbore. In one embodiment, opening 42 may include a flow regulator to allow selective opening and closing thereof.

In one embodiment, casing flow regulators 23 function as both hydraulic fracture diversion valves and as injection flow regulators (as described above) or production flow regulators (as described above). Each casing flow regulator may be remotely and/or independently operated. Each casing flow regulator has an open position and a closed position, and the open position may include one or more partially open positions (e.g., screened, choked, etc.). In the open position, the casing flow regulator 23 is in communication with the horizontal section of the wellbore through an opening in casing 14. In the closed position, casing flow regulator 23 blocks fluid flow therethrough. Each casing flow regulator 23 therefore allows fluid communication between the fracture(s) connected thereto and the wellbore, when the casing flow regulator is in an open position.

Accordingly, when any one of the casing flow regulators 23 is open and when the opening 42 in the conduit 19 is open, conduit 19 is in fluid communication via the wellbore with the fracture(s) connected to the open casing flow regulator(s).

In operation, the system in the sample embodiment shown in FIG. 8 allows asynchronous injection into and production from a well using only one conduit. For example, injection fluid is pumped down conduit 19 and flows through opening 42 into the wellbore. Some of the casing flow regulators 23 are then opened, while others are kept closed, so that the injection fluid in the wellbore can flow through the open casing flow regulators into the fractures connected thereto.

Once the desired amount of injection fluid has been injected into the wellbore, the pumping of injection fluid down conduit 19 is stopped. In one embodiment, the open casing flow regulators 23 are closed and the casing flow regulators that were closed during the injection of injection fluid are then opened to allow reservoir fluid to flow therethrough, from the fractures connected to the casing flow regulators into the wellbore. In another embodiment, one or more of the previously opened flow regulators may be left open and one or more of the previously closed flow regulators may be opened or left closed. If the opening 42 in conduit 19 is open, reservoir fluid in the wellbore can flow through the opening 42 and be collected in conduit 19 for transportation to surface.

Figure 9:
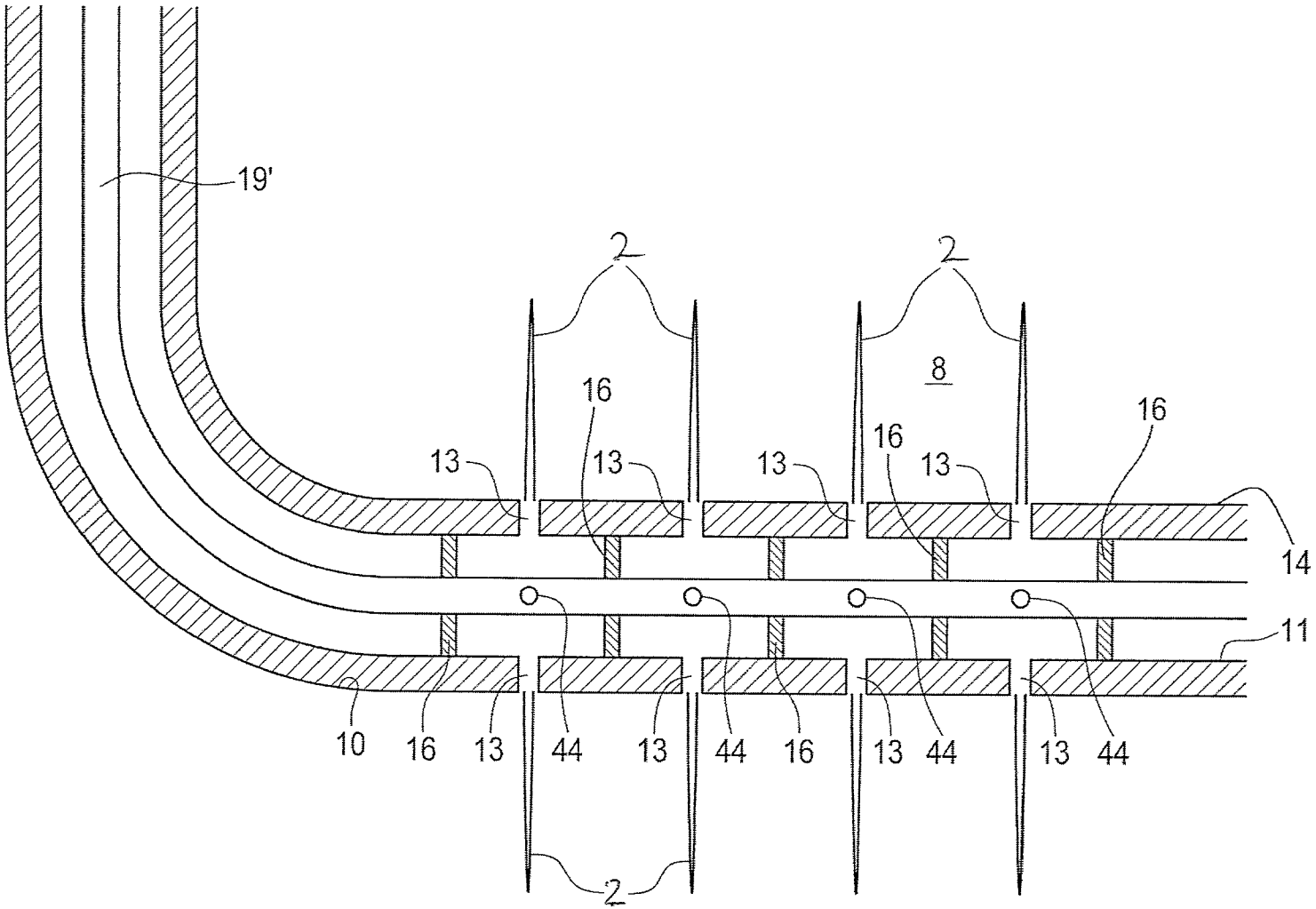
FIG. 9 is a cross-sectional view of yet another embodiment of the invention, where one conduit is used for both injection and production.

Referring to FIG. 9, a sample embodiment is shown wherein one conduit 19' is provided for transporting both injection fluid and reservoir fluid therein. Therefore, in this embodiment, the injection conduit and the production conduit are one and the same. This embodiment is usable with a cased well having a casing 14 which is cemented to wellbore wall 10 in at least the horizontal section. Here, the wellbore inner surface 11 is the inner surface of casing 14. Conduit 19' extends down the well through the heel and into at least a portion of the horizontal section.

Further, instead of injection flow regulators and production flow regulators, a plurality of flow regulators 44 are provided in conduit 19, intermittently positioned along the length of the conduit. Flow regulators 44 function as injection flow regulators (as described above) and/or production flow regulators (as described above). Each flow regulator 44 may be remotely and/or independently operated. Each flow regulator 44 has an open position and a closed position, and the open position may include one or more partially open positions (e.g., screened, choked, etc.). In the open position, the flow regulator 44 allows fluid to flow therethrough into or out of conduit 19. In the closed position, the flow regulator 44 blocks fluid flow therethrough.

Conduit 19' extends axially along the horizontal section of the wellbore defined by wellbore inner surface 11. Packers 16 are intermittently positioned on the outer surface and along the length of the conduit 19'. Packers 16 may be positioned on conduit 19' such that at least one flow regulator 44 is situated in between each pair of adjacent packers 16. Further, adjacent packers 16 are positioned and expanded (i.e., installed) relative to the perforations 13 in casing 14 in the horizontal section such that at least one perforation 13 is situated in between at least a pair of adjacent packers 16. In this manner, packers 16 are provided and positioned in the horizontal section of the well to fluidly seal the annulus between the wellbore inner surface and conduit 19 to define zones, as discussed above. The zones are fluidly sealed from one another inside the horizontal section but can fluidly communicate with one another via the conduit 19'.

In this embodiment, each zone is in communication with at least one fracture, via at least one perforation 13, and is communicable with conduit 19 via at least one flow regulator 44. The flow regulator 44 in each zone therefore allows fluid communication between the fracture(s) connected to the zone and conduit 19', when the flow regulator 44 is in an open position. In the closed position, flow regulator 44 blocks fluid communication between the fracture(s) connected to the zone and the conduit 19'. One zone can fluidly communicate with another zone if the flow regulators 44 in the zones are open.

In operation, the system in the sample embodiment shown in FIG. 9 allows asynchronous injection into and production from a well using only one conduit. For example, injection fluid is pumped down conduit 19' and one or more of the flow regulators 44 are then opened so that the injection fluid can flow out of the open flow regulators through the zones in which the open flow regulators are situated and into the fractures connected those zones.

Once the desired amount of injection fluid has been injected into the formation, the pumping of injection fluid down conduit 19' is stopped. In one embodiment, the open flow regulators are closed and the flow regulators that were closed during the injection process are opened. Alternatively, some of the open flow regulators may be left open and one or more of the previously closed flow regulators may be opened or left closed. Any reservoir fluid from the formation flowing into the zones through the fractures is collected in the conduit 19' via the open flow regulators 44. The collected reservoir fluid in conduit 19' is then transported to surface, as discussed above.

The system of the present invention may employ instrumentation to help monitor the injection and/or production zone environment, which allows specific controls to be applied in order to manage the above-described injection-production method. The instrumentation may include for example measurement devices for monitoring fluid properties and pressure or temperature conditions at each production or injection zone. The instrumentation may also be used to monitor the health of the system including for example, whether packers are sealing properly, whether the casing cement is isolating annular injection flow into the fractures or is allowing short-circuiting such as through an annulus cement channel between an injection zone and an adjacent production zone, and to help identify the location of a leak in a flow conduit or an improperly functioning flow regulator.

In one embodiment, a device for monitoring the concentration of the injection fluid in the petroleum being produced in the wellbore is installed adjacent to the fractures in one or more of the production zones. Examples of such measurement and monitoring devices include for example fluid flow meters, electric resistivity devices, oxygen decay monitoring devices, fluid density monitoring devices, pressure gauge devices, and temperature monitoring devices that obtain measurements at discrete locations, or distributed measurement devices such as fiber optic sensors to measure distributed temperature, distributed acoustic soundfield, chemical composition, pressure, etc. Data from these devices can be obtained through electric lines, fiber-optic cables, retrieval of bottom hole sensors, in well interrogation of the devices using induction coupling, wireless or other methods common in the industry.

In another embodiment, a sampling line is installed into the production conduit. The sampling line may be a tubing (coiled or jointed) that takes a sample of the fluid in one or more production zones. In yet another embodiment, a sampling chamber is formed in one or more production zones so that discrete samples of fluid can be taken.

With the above-described devices and monitoring techniques, the proportion of injection fluid in reservoir petroleum can be estimated or measured for any particular production zone to help with determining, for example: (i) when to stop injecting fluid into the well; (ii) when to stop injecting fluid into one or more zones of the well; and/or (iii) when to stop producing one or more zones of the well.

The system may also be in communication with well logging devices, and seismic or active sonar imaging devices for measuring the progress of sweeping by, for example, fiber optic acoustic detection of the echo produced by a sound pulse originating at the wellbore and analysis of the returned echo waveform properties to infer distance to reservoir boundaries or heterogeneities including natural or hydraulic fractures or the general fluid composition in the reservoir through which the sound pulse traveled.

Instrumentation that may be used with the system includes for example, fiber optic distributed temperature sensors ("DTS"), fiber optic distributed acoustic sensors ("DAS"), fiber optic distributed pressure sensors ("DPS"), fiber optic distributed chemical sensors ("DCS"), and permanent downhole gauges ("PDGs").

A DTS may be used with the system to measure the temperature inside or outside the casing string at along its length in real time. Additionally or alternatively, a DAS may be used to measure the sound environment inside the horizontal wellbore section along its length in real time. Additionally or alternatively, a DPS may be used to measure the pressure inside the horizontal wellbore section continuously or pseudo-continuously at a multitude of discrete points along its length in real time. In a sample embodiment, both DTS and DAS are housed together in a separate stainless steel control line running substantially the full length of the production conduit.

In a further embodiment, PDGs are used at each injection and/or production zone to electronically measure the pressure and temperature therein, and an electric cable is used to provide power to each gauge and/or to transmit signal data to the surface. In a sample embodiment, the PDGs are fiber optic devices which optically measure both temperature and pressure at discrete points within the well and may use an optic fiber to optically convey the measurement signal to surface. A single cable may be used for each gauge or for a plurality of gauges.

Downhole separation of gas from the produced petroleum may be accomplished using a downhole separator to separate the gas from the produced petroleum in the production conduit. The separator may be, for example, a cyclone-type or hydrocyclone-type separator. The separation may be followed by compression of the collected gas to the pressure of the injection fluid in the injection conduit, and the compression may be achieved by a centrifugal compressor or a reciprocating compressor. The compressed collected gas may be supplied to the injection conduit as injection fluid. The separator may include an electric submersible or progressing cavity pump, which may be used to impart energy into the produced fluid to help lift the fluid to surface.

Referring to the sample embodiments shown in FIGS. 6 and 8, measurement and control system instrumentation including for example pressure gauges, fiber optic sensors, and hydraulic and electric control lines 39, etc. may be installed outside casing 14 (i.e., between wellbore inner surface 11 and wellbore wall 10). Alternatively or additionally, the flow regulators 23 may be controlled with radio-frequency identification ("RFID"). Alternatively or additionally, measurement system components including gauges and fiber optic sensors may be installed on or near the outer surface of the production conduit 20. The placement of the casing flow regulators and/or instrumentation outside the casing may help reduce the complexity of the required downhole tubing equipment for the conduits.

With respect to the above-described injection-production system, there is provided a method of enhancing petroleum production from a well having a well section with a wellbore inner surface in communication with a plurality of fractures in a formation containing reservoir fluid, the method comprising: creating a first set and a second set of zones in the well section, each zone for communicating with at least one of the plurality of fractures, and the first set of zones being fluidly sealed from the second set of zones in the well section; and selectively injecting injection fluid into the formation via at least one zone in the first set of zones. The method further comprises selectively collecting reservoir fluid from the formation via at least one zone in the second set of zones; and transporting the collected reservoir fluid to surface.

At least some of the fractures associated with the first set of zones are in direct or indirect fluid communication with at least some of the fractures associated with the second set of zones. The fractures communicable with the first set of zones are not necessarily distinct from the fractures communicable with the second set. Also, the zones in the first set are not necessarily distinct from the zones in the second set. There may be overlaps in the two sets of zones, such that any one zone can be in both the first set and the second set. In other words, any one zone of either set may function as one or both of an injection zone and a production zone. Further, each set of zones may contain one or more zones.

In one embodiment, the method comprises: running a production conduit and an injection conduit down the well and setting up isolated zones along the conduits. To set up the isolated zones, cement may be introduced to the annulus or the production conduit and/or the injection conduit may have installed thereon packers in the retracted position and the packers may be expanded to engage the wellbore inner surface. Regardless, the cement or packers fluidly seal the annulus between the outer surface of the conduits and the wellbore inner surface to define at least one injection zone and at least one production zone, the production zone being isolated from fluid migration through the annulus from the injection zone. If packers are used, the at least one injection zone may be between a pair of adjacent packers and the at least one production zone between another pair of adjacent packers. The at least one injection zone is in communication with at least one fracture and the at least one production zone is also in communication with at least one fracture.

The method further comprises supplying injection fluid to the injection conduit. The injection fluid may be supplied from a supply source at surface. Alternatively or additionally, injection fluid may be recovered and separated from the produced fluids in the production conduit, compressed, and then re-injected into the injection conduit. In one embodiment, any or all of the recovering, separating, compressing, and re-injecting of injection fluid may be performed downhole.

The method further comprises selectively injecting injection fluid into one of the at least one injection zone. In one embodiment, the pressure at which injection fluid is injected into the injection zones ranges between the minimum miscibility pressure of the target reservoir fluid and the minimum hydraulic fracture propagating pressure of the target reservoir formation. Minimum miscibility pressure may be determined in a lab by re-pressurizing a sample of the reservoir fluid. The sample is obtained and analyzed using a specific process known as PVT testing. As the injection fluid is pumped into the reservoir via the fractures in the injection zones, a pressure gradient is created in the reservoir between the injection and production zones, resulting in flow in the direction of the pressure gradient from the injection zones to the production zones. The flood of injection fluid into the reservoir causes the pressure of the reservoir to rise to at least above the minimum miscibility pressure of the petroleum in the reservoir, thereby trapping otherwise free gas in solution, which results in a higher relative permeability of the petroleum in the formation. In one embodiment, a dissolvable injection fluid is injected into the fractures to increase the mobility of the reservoir petroleum in order to help improve the production rate. Petroleum in the reservoir moves through the fractures and into the production zones.

The method further comprises selectively collecting reservoir fluid (including petroleum) from one of the at least one production zone into the production conduit. The method may further comprise transporting the reservoir fluid in the production conduit to surface. As discussed above, the reservoir fluid may be transported by pumping and/or gas lifting.

The selective injection of injection fluid may be accomplished by opening or closing at least one injection flow regulator of the injection conduit in the one of the at least one injection zone. The selective collection of reservoir fluid may be accomplished by opening or closing at least one production flow regulator of the production conduit in the one of the at least one production zone.

In one embodiment, the injection of injection fluid into the at least one injection zone occurs substantially simultaneously as the collection of reservoir fluid from the at least one production zone. In another embodiment, the injection of injection fluid and the collection of reservoir fluid occur asynchronously, such that there is substantially no simultaneous flow in both conduits. Injection fluid may be continuously, periodically, or sporadically pumped into the reservoir via the injection zones.

The production zones may or may not all flow at the same time. For example, one or more production zones may be selectively shut off from collecting reservoir fluid temporarily or permanently. As mentioned above, by shutting off one or more production zones for a certain period of time, the injection fluid is allowed to penetrate deeper into the reservoir which may help increase petroleum production. In a further embodiment, selected production zones may be shut off while the remaining production zones are open and allowed to produce petroleum, and the pattern or sequence of which production zones are opened or shut off at any given time may be configured as required to optimize the performance of the system.

In another embodiment, a method for enhancing petroleum production from a well having a wellbore with a wellbore inner surface, the wellbore communicable via the wellbore inner surface with a first set and a second set of fractures in a formation containing reservoir fluid, the method comprising: supplying injection fluid to the wellbore via a conduit; injecting injection fluid from the wellbore to the formation through the first set of fractures, while blocking fluid flow to and from the second set of fractures; ceasing the supply of injection fluid; blocking fluid flow to and from the first set of fractures; permitting flow of reservoir fluid from the formation through the second set of fractures into the wellbore; and collecting reservoir fluid from the wellbore via the conduit.

At least some of the fractures of the first set are in direct or indirect fluid communication with at least some of the fractures of the second set through the formation. The fractures in the first set are not necessarily distinct from the fractures in the second set. There may be overlaps in the fractures of the two sets. Also, each set of fractures contains one or more fractures.

Figure 7:
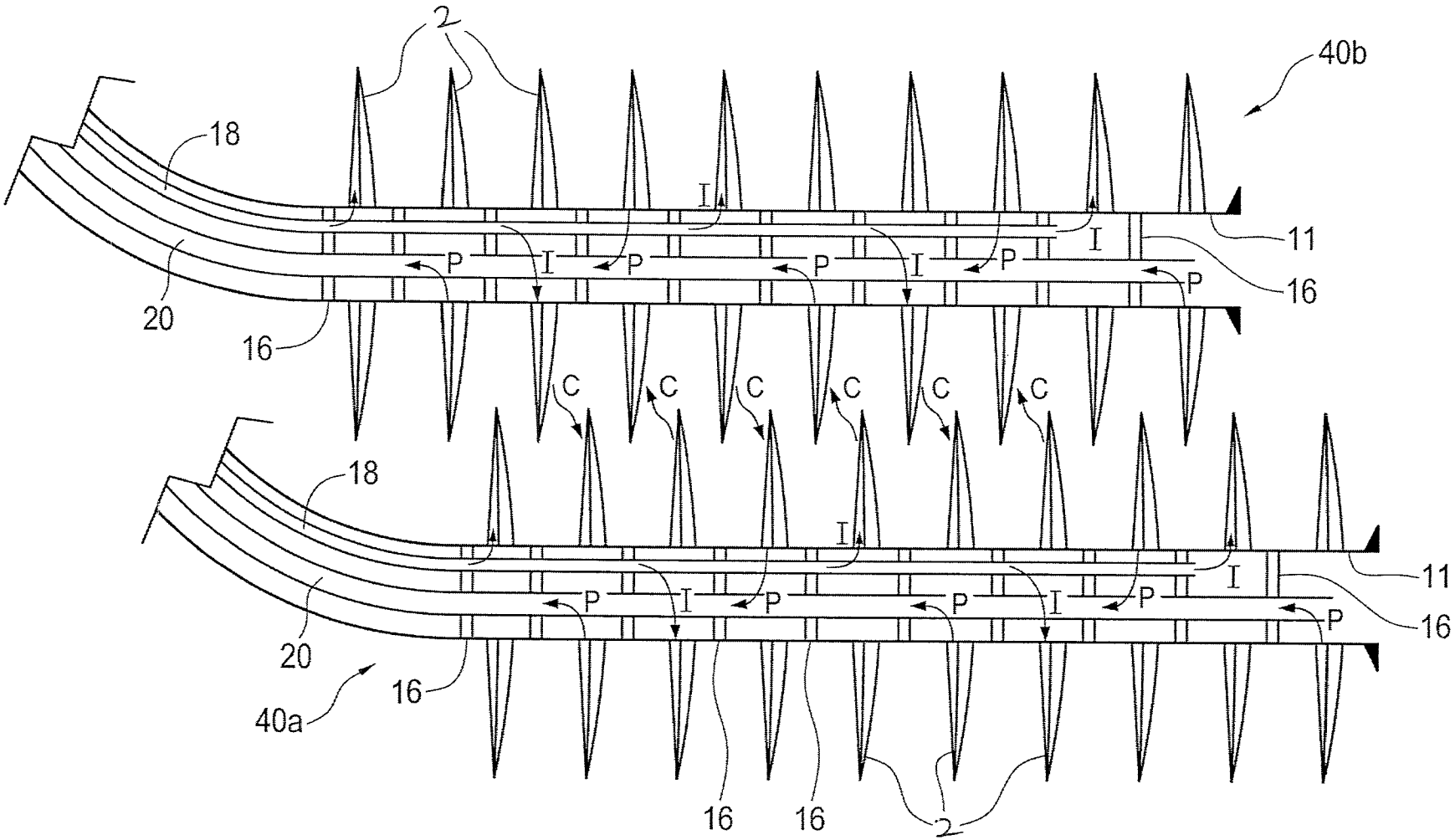
FIG. 7 is a schematic diagram illustrating another embodiment of the invention, which involves two adjacent wellbores.

Another method for producing petroleum involves using a plurality of injection-production systems together to influence inter-well reservoir regions to allow sweeping between fractures that originate from different wellbores. For example, the injection-production system may be used for separate wells with alternating fracture positions, as illustrated in FIG. 7. A fractured well 40*a* is near at least one other fractured well 40*b*. Well 40*b* may be spaced apart from well 40*a* in any direction, including for example lateral, diagonal, above, below, or a combination thereof. The long axes of the wells may or may not be parallel to each other, and may or may not share the same plane. Each of the wells 40*a* and 40*b* has the above described injection-production system installed therein.

Some of the fractures of well 40*a* may be in close proximity to some of the fractures of well 40*b* and may extend between some of the fractures of well 40*b*, and vice versa. Because of the proximity of some of the fractures between the two wells, cross flows may occur therebetween, as indicated by the arrows C. More specifically, for example, some of the injection fluid injected into well 40*b* may flow out of the fractures toward the fractures of well 40*a*, which may sweep petroleum in the reservoir to flow into the production zones of well 40*a*. Similarly, some of the injection fluid injected into well 40*a* may flow out of the fractures toward the fractures of well 40*b*, which may sweep petroleum in the reservoir to flow into the production zones of well 40*b*. These cross flows C may enhance petroleum production by allowing more extensive sweeping of the reservoir, which might not be possible with only one fractured well.

In one embodiment, injection fluid is injected into both wells 40*a* and 40*b* in order to produce reservoir petroleum from both wells. In another embodiment, injection fluid is injected into only one well and petroleum is produced from both wells. In yet another embodiment, injection fluid is injected into only one well and petroleum is produced from the other well. In a further embodiment, the injection of injection fluid into the wells and/or the production of petroleum from the wells may be selectively turned on and off to alternate the pattern of injection and/or production between the wells. Of course, other injection and/or production patterns and sequences are also possible.

In addition, there may be more than two adjacent fractured wells having the injection-production system, such that one well may provide cross flows to one or more adjacent wells. The plurality of wells may be oriented in many different directions relative to one another and the injection and/or production patterns and sequences of the plurality of wells can be selectively modified and controlled, as described above with respect to wells 40*a* and 40*b*.

In another sample embodiment, the string, in addition to allowing side-by-side injection and production, additionally permits fracturing through the casing string to create fractures in the formation. As noted previously, there are many ways to initiate hydraulic fractures at specific locations in the wellbore, including for example by hydra jet, by staged hydraulic fracturing using various frac port actuators including mechanical diversion tools and methods applicable to open wells or cased wells, by using a limited entry perforation and hydraulic fracture technique (which is generally applicable to cased cemented wells), etc. Other techniques for placing multiple hydraulic fractures in a horizontal well section include for example: a multiple repeated sequence of jet perforating the cased cemented hole followed by hydraulic fracturing with temporary isolation inside the wellbore using mechanical bridge plugs; wireline jet perforating the cased and cemented hole to initiate the hydraulic fracture at a specific interval while preventing the fracture treatment from re-entering previously fractured intervals using perforation ball sealers and/or other methods of diversion; hydra jet perforating with either mechanical packer or sand plug diversion; various open-hole packer and valve systems; and manipulating valves installed with the cemented casing using coiled tubing or jointed tubing deployed tools. As such, to permit fracturing, the string through which fracturing is to be accomplished can be simply sized to permit fracturing therethrough and may be configured with valves, landing areas, ports, etc. to accept the fracturing apparatus and process.

In one embodiment, the string includes frac valves manipulated by pressure or a tethered or untethered actuator that allow a valve-based and possibly staged fracturing process to be conducted through the same string that is to be employed for injection and production. The frac valves may be positioned in the production conduit in both injection zones and production zones, but includes a closure that allows the injection zones to be closed off when the process of setting up the injection and production zones is desired, such as when injection through the injection conduit is to be initiated.

Figure 12A:
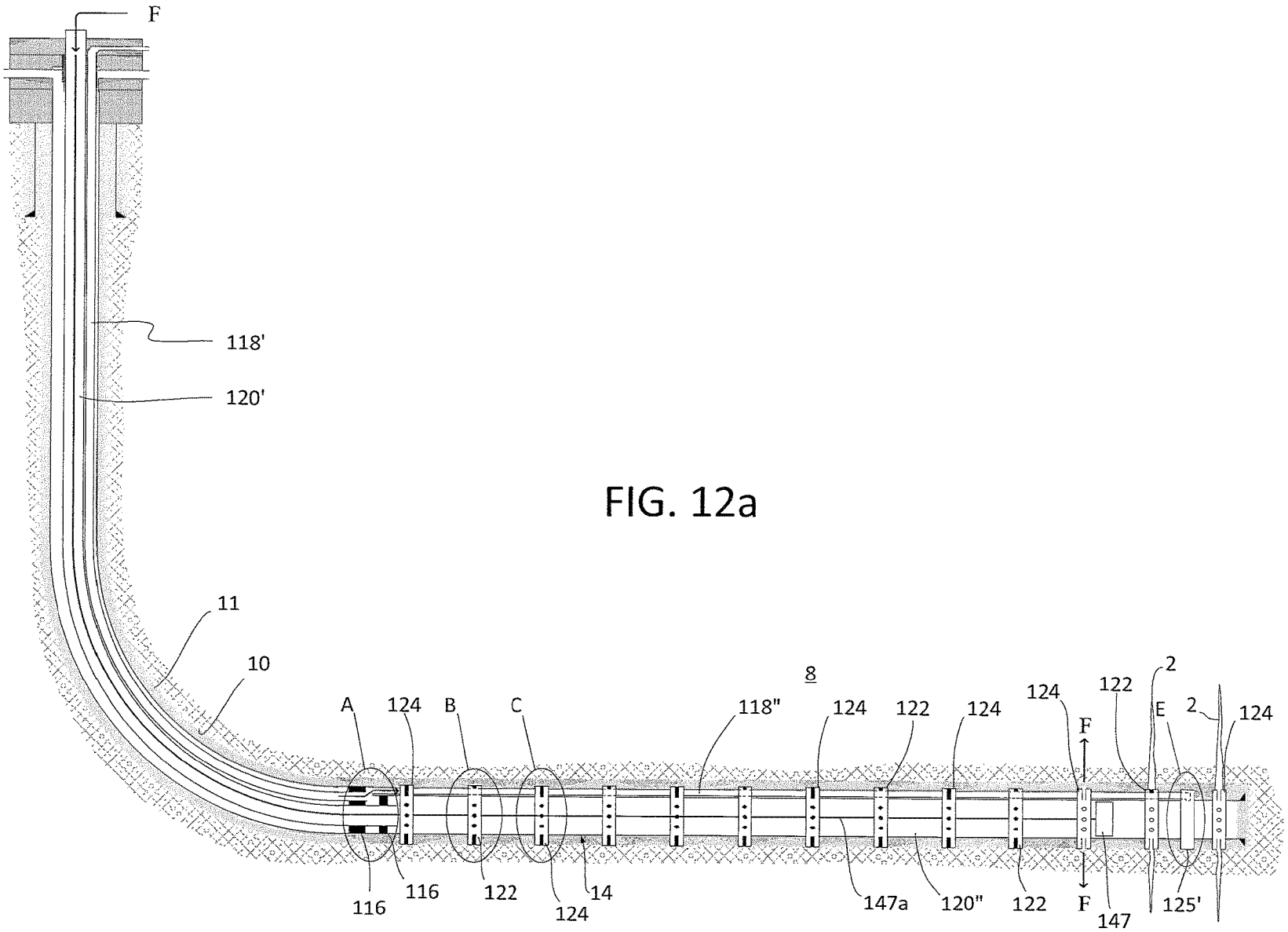
FIGS. 12*a*, 12*b* and 12*c* are cross-sectional views of further embodiments of the invention, with flow regulators having selectively openable and closeable ports from the production conduit.
Figure 12B:
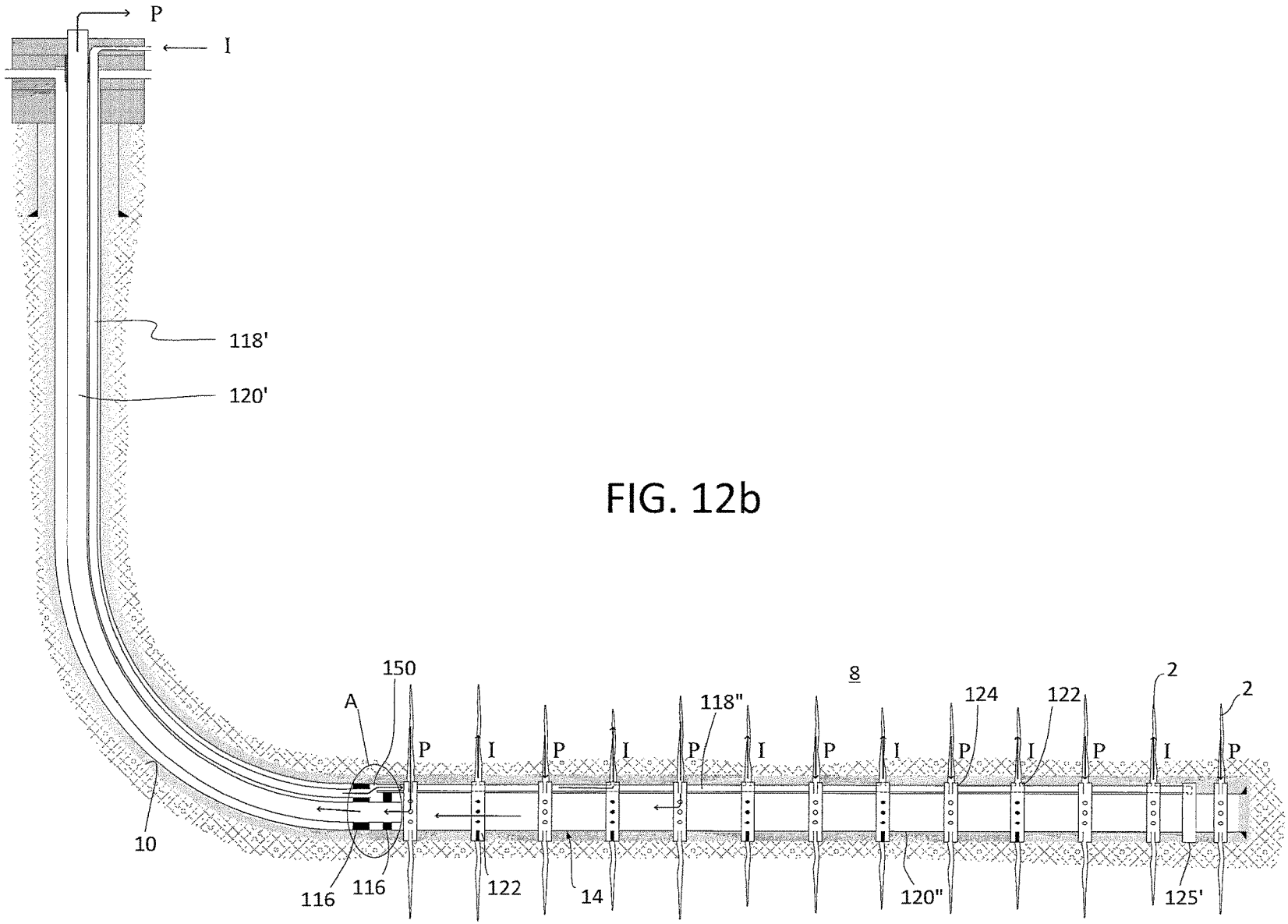

Such an embodiment is shown in FIGS. 12*a* and 12*b*, wherein a string 14 is installed within a wellbore defined by wall 10. The string 14, according to the systems described hereinbefore, includes a production conduit and an injection conduit. In this embodiment, the production conduit has an upper portion 120' and a lower portion 120" and the injection conduit also has an upper portion 118' and a lower portion 118".

The upper portion 120' of the production conduit is a tubing that extends from an uphole position, for example, from the surface and into the well to a producing formation. Upper portion 120' may extend to a junction A with the lower portion 120". Lower portion 120" extends axially along at least a portion of the horizontal section of the well and is in fluid communication with the upper portion 120'.

The upper portion 118' of the injection conduit is a tubing that extends from a position uphole, such as from the surface to the junction A, where upper portion 118' is in communication with a lower portion 118". Lower portion 118" extends axially along at least a portion of the horizontal section of the well. The lower portion 118" may be an extension of the tubing of the upper portion 118' or may be a separate tubing from that of the upper portion 118' but in fluid communication therewith.

The upper portions 118' and 120' extend parallel to each other but are fluidly sealed from one another. The space defined between outer surfaces of the upper portions 118' and 120' and the inner surface 10 of the well is fluidly sealed by one or more packers 116, preferably at the heel portion of the well or at the upper end of the horizontal section.

In this sample embodiment, a plurality of production flow regulators 124 and a plurality of injection flow regulators 122 are intermittently positioned along the length of the horizontal section of the well. As noted above, the flow regulators 122, 124 operate by injecting into some zones and producing from others. Flow regulators 122, 124 require zonal isolation to achieve a staggered (also called alternating) injection/production operation and, as such, there may be packers or cement installed in the annulus about string 14 between each adjacent pair of different flow regulators. In other words, the annulus is sealed against annular migration of fluid from regulator 122 to regulator 124 in each location where a production flow regulator 124 is positioned axially adjacent an injection flow regulator 122. In this embodiment, this zonal isolation is provided by cementing the annulus along the full length of string 14 at least in the horizontal section.

The flow regulators 122 and 124 may be based on one of the various embodiments described above but each include a valve through which fracturing pressure can be conveyed to generate hydraulic fractures in formation 8. For example, each flow regulator 122, 124 includes a port through the wall of the string through which a hydraulic fracturing treatment will be done. The valves are each selectively openable to allow fluid communication between the string inner bore and the string outer surface, which when installed is open to the formation. When installed, each valve may be closed and then selectively opened to allow a hydraulic fracture treatment to be placed therethrough. Each valve's outer surface is open to the formation.

Fracturing fluid is pumped at high pressure down the string to exit the opened port of the selected regulator or regulators to make contact with the formation to cause the formation to fracture. These ports are all in the same one of the production conduit or the injection conduit so that the fracturing fluid can be conveyed through that one conduit to reach all flow regulators in the string and the fracturing process can be conducted in a consecutive process, one zone at a time, or into pluralities of zones all at once. Because for the illustrated conduit size configuration, the production conduit has a relatively large diameter compared to that of the injection conduit, the ports for hydraulic fracturing may be positioned in the production conduit so that there is more flow area to pump fluids at rates required for hydraulic fracturing and more internal clearance to convey tubing or wireline tools therethrough to actuate closure mechanisms, etc., as desired.

Since the string may be used to both fracture through and then inject and produce through, wellbore operations are facilitated and the operator can be assured that each of the flow regulators 122, 124 is thereby in communication with at least one fracture 2 in the formation 8.

Figure 13B:
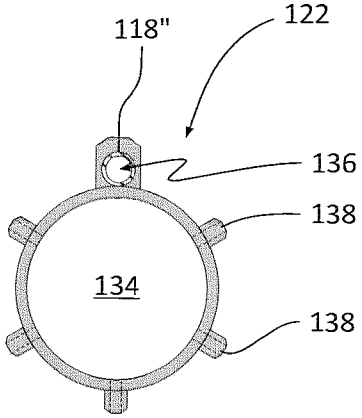
FIGS. 13*a*, 13*b*, and 13*c* are a cross-sectional view showing an open position, an end view, and a cross-sectional view showing a closed position, respectively, of an injection flow regulator usable in area "B" of the system shown in FIG. 12*a*, according to one embodiment of the invention.
Figure 13A:
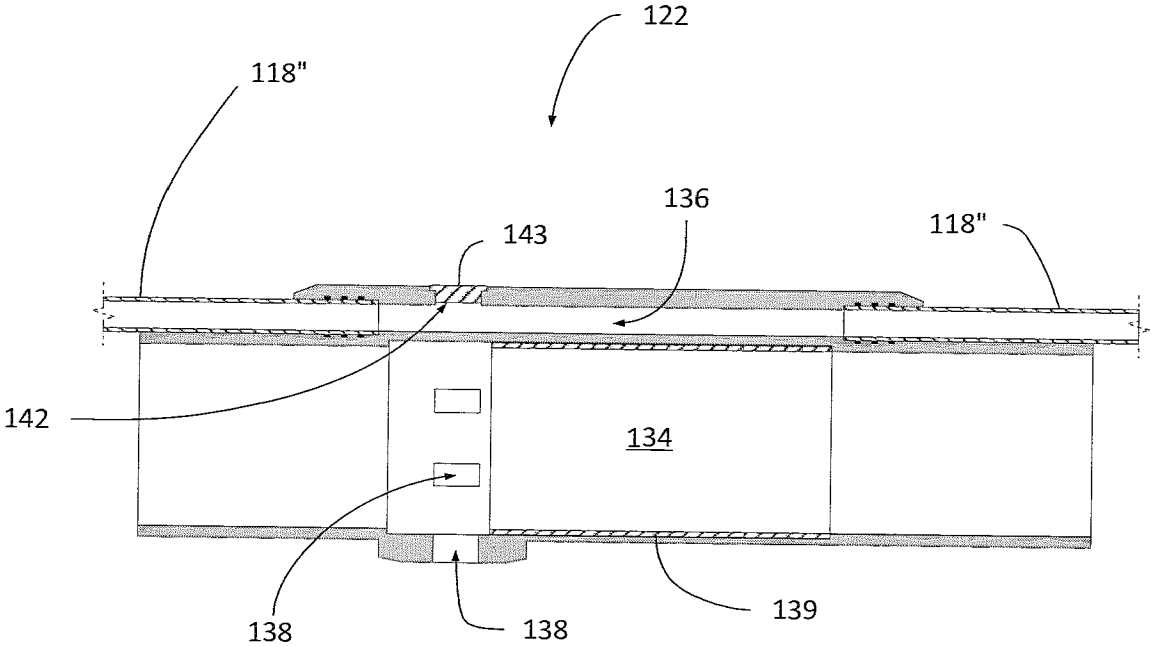
Figure 13C:
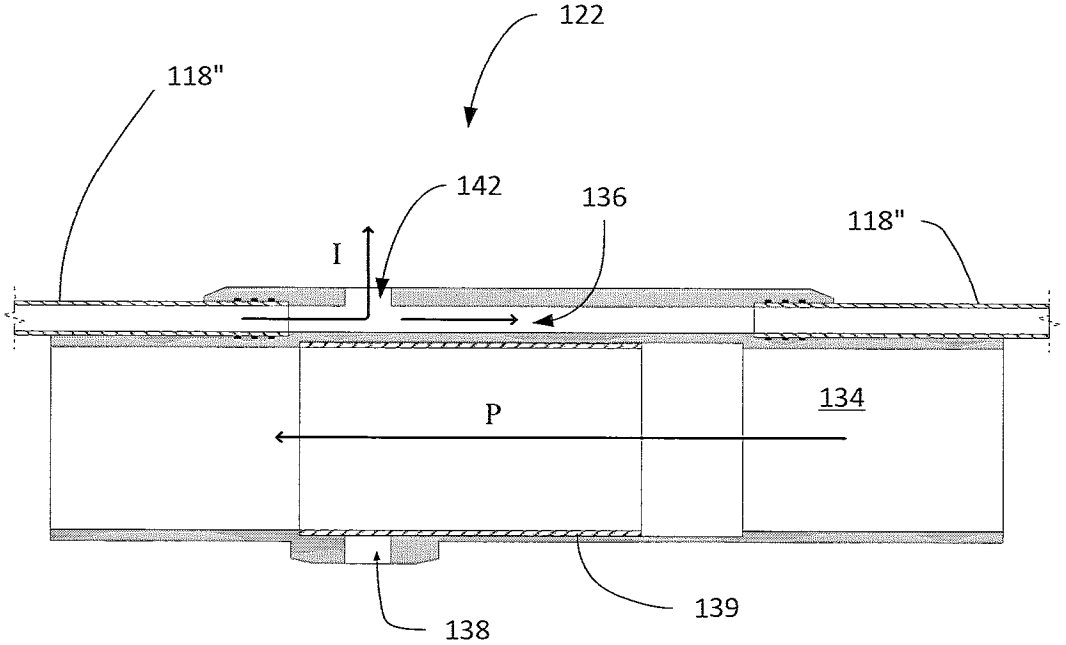

FIGS. 13*a*-13*c* show a sample injection flow regulator 122 including a production tubular forming a production passage 134 and an injection tubular forming an injection passage 136. Unlike other injection flow regulators described in embodiments hereinabove, production passage 134 has one or more fracturing ports 138 and a mechanism 139 for selectively opening and closing the one or more fracturing ports, the mechanism may be configured for manipulation by an actuator tool or by other signaling. Mechanism 139 may be, for example, a slidable sleeve. The one or more fracturing ports 138, when open, allow fluid communication between the production passage 134 and the outer surface of the production tubular, which is open to the annulus and therethrough the formation. When the one or more fracturing ports 138 are closed by mechanism 139, fluid flow is sealed within the production passage and is limited to flowing axially therethrough and cannot flow into the annulus.

Fracturing ports 138 open from production passage 134 to the exterior of the flow regulator, without also opening into injection passage 136.

Like other injection flow regulators described in embodiments hereinabove, injection passage 136 has one or more injection ports 142 for allowing fluid communication between the injection passage and the formation. However, the injection ports 142 are preferably initially closed when the injection flow regulator 122 is placed in the well and the injection ports can be opened subsequently at a desired time. The injection ports may include a mechanism 143 for closing injection ports 142 initially and opening same as desired subsequently. Mechanism 143 may be, for example, a plug that is removable by fluid pressure and/or chemical dissolution. The plug may be made of materials such as aluminum or other chemically reactive materials. The one or more injection ports 142, when open, allow fluid communication between the injection passage 136 and the annulus, and therethrough the formation, about the string, and restrict fluid flow between same when closed.

Ports 142 are positioned axially close to or in the same axial location, positionally overlapping with, ports 138 along the string. In particular, in each regulator 122, port 142 is positioned along its injection tubing in an axial position which is close to or overlapping with the axial location of ports 138 in the production tubing.

Flow regulator 122 has a closed configuration, a hydraulic fracturing configuration and an injecting configuration. The closed configuration is when both fracturing ports 138 and injection ports 142 are closed. This may be the configuration during run in or when flow regulator 122 is not in use, for example, before or after hydraulic fracturing and before injection. In the hydraulic fracturing configuration, as shown in FIG. 13*a*, the one or more fracturing ports 138 are open and injection port 142 is closed. In the injecting configuration, as shown in FIG. 13*c*, the one or more fracturing ports 138 are closed and injection port 142 is open.

FIG. 14 show a sample production flow regulator 124 having a production tubular forming production passage 144. Like other embodiments of production flow regulators described above, production passage 144 of this production flow regulator has one or more production ports 148. However, while production ports 148 may allow flow of produced fluids into the production passage, ports 148 also serve an additional purpose as they may initially be used for communicating fracturing fluids to fracture the formation about flow regulator 124. The ports may be formed downhole, as by perforating or jetting, or may be preformed. If preformed, a mechanism 149 is provided for selectively opening and closing the one or more ports 148. Mechanism 149 may be, for example, a slidable sleeve. The one or more production ports 148, when open, allow fluid communication between the production passage 144 and the formation. When ports 148 are closed by mechanism 149, fluid is sealed from flowing between production ports 148 and annulus/formation.

Figure 14B:
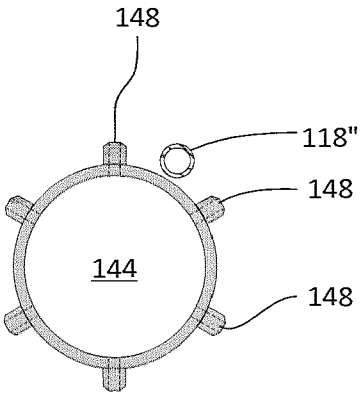
FIGS. 14*a* and 14*b* are a cross-sectional view showing an open position and an end view, respectively, of a production flow regulator usable in area "C" of the system shown in FIG. 12*a*, according to one embodiment of the invention.

In one embodiment, production flow regulator 124 provides a space for lower portion 118" of the injection conduit to extend alongside and bypass the production flow regulator without any fluid communication with the production passage. For example, as shown in FIG. 14*b*, a tubular defining a length of lower portion 118" is disposed on the outer surface of flow regulator 124, thereby allowing fluid to flow through lower portion 118" along the length of the flow regulator 124 independently from any fluid flowing in the production passage 144 or through ports 148.

In an alternative embodiment, flow regulator 124 may have substantially the same construction as injection flow regulator 122 as shown in FIG. 13, except that the injection passage does not have port 142 and injection conduit 118" is therefore always fluidly sealed from the formation as it extends along beside flow regulator 124.

Referring to FIGS. 12*a* to 14*b*, regulators 122, 124 are subs formed at the ends of their tubulars for interconnection together or with other subs or jointed tubulars (i.e., casing tubulars, liner tubulars, etc.) to form string 14. For example, the lower portion 118" of the injection conduit extends along the length of the horizontal section of the well through the intermittently positioned production flow regulators 124 and is formed in part by the injection tubulars of injection flow regulators 122. For example, the lower portion 118" is a long length of tubing formed continuously or in sections that forms the injection passage through regulators 122 and bypassing regulators 124. Lower portion 118" extends past the production flow regulators 124, as described above, without fluid communication with production passages 144 and the formation and is in fluid communication with the injection passages 136 of the injection flow regulators 122. For example, lower portion 118" comprises one or more sections of tubing, each section being connected at one end to the injection passage of a first injection flow regulator and connected at the other end to the injection passage of a second injection flow regulator, thereby allowing unrestricted fluid flow between the injection passages of the first and second injection flow regulators through the section of tubing. Further, the section of tubing may bypass one or more production flow regulators. Alternatively, the section of tubing may directly connect two injection passages of two adjacent injection flow regulators without bypassing any production flow regulators.

The lower portion 120" of the production conduit is formed at least in part by connecting the production tubulars that form passages 134, 144 of the plurality of flow regulators 122, 124.

The string can be installed in the wellbore with the portions 118" and 120" formed by interconnected flow regulators 122, 124 positioned along the length of the horizontal section of the well. Installation may include the setting of packers and/or cementing of the annulus between the string and the formation.

Figure 14A:
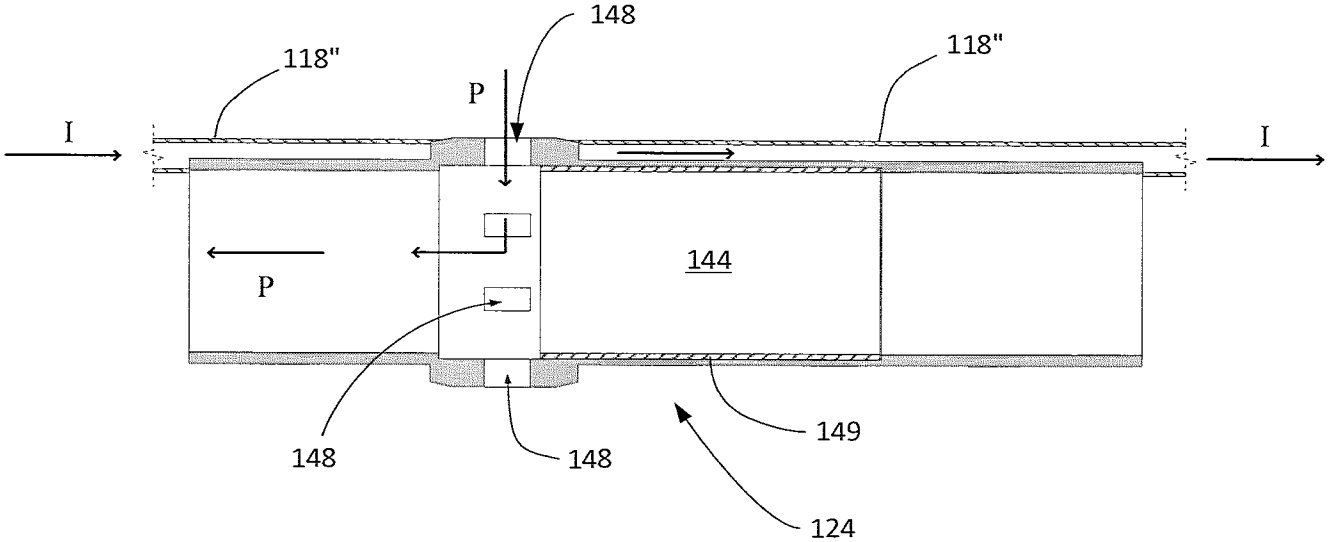

After the string is set in the well, a fracturing fluid may be conveyed through the string 14 to hydraulically fracture, arrow F, the formation to form fracs 2. To do so, the fracturing ports 138 and production ports 148 are opened, if they are not already so configured, and fracturing fluid at high pressure is conducted through the string to pass through the ports 138, 148 to fracture the formation. FIGS. 13*a* and 14*a* show flow regulators 122, 124, respectively, in their hydraulic fracturing configurations with ports 138, 148 opened.

While the fracturing fluid may be conveyed through all ports simultaneously, it is also possible to fracture the formation along portion 120" in stages, wherein fracturing fluid is conveyed through one or a small number of flow regulators 122, 124 at a time.

In one embodiment, therefore, mechanisms 139, 149 are independently actuatable to open and possibly close.

There are a number of options for staged hydraulic fracturing including line-conveyed fracturing systems, such as NCS™-type systems, or plug-actuated systems, such as Packers Plus™-type systems, which use untethered actuator plugs, such as a launched ball. The fracturing system to be employed may be selected based on a number of factors. In one embodiment, available dimensions are considered. For example, an NCS™-type system relies on a line-conveyed actuating device while pumping and therefore requires a minimum tubular diameter for a required internal clearance.

The line may reduce the effective hydraulic flow area. On the other hand, Packers Plus™-type systems relies on an untethered ball to actuate a closure for the fracturing port. The ball does not occlude the flow area during fracturing. As such, Packers Plus™-type systems may be useful in smaller diameter tubing systems.

The embodiment of FIG. 12*a* is a line-conveyed system wherein, a device 147 such as a port-opening tool may be run into production conduit 120" to actuate one or more mechanisms 139, 149 to open their ports, while other ports 138, 148 are closed. The device may be on a work string 147*a* such as a jointed string, coiled tubing, wireline, etc. and together device 147 and work string 147*a* are configured to be run through production conduit 12011 to actuate mechanisms 139, 149. The device may operate to open the mechanisms by physical engagement and/or by hydraulic pressure, to move or otherwise reconfigure the mechanisms to open. In some embodiments, mechanisms 139, 149 are sleeves that can be (i) mechanically opened by an opening tool configured to engage and move the sleeve or (ii) hydraulically opened by creating a pressure differential across a piston face on the sleeve.

For staged fracturing, device 147 must close the mechanisms for ports already opened or device 147 or another sealing device may be employed to create a plug below and/or above the port or ports being fractured into so that fracturing fluid may be diverted to only the selected, opened port(s) of interest for hydraulic fracturing. If a seal is used, the device 147 or other sealing device, for example, may be a packer cup or expandable packer carried on the work string, which is settable below the port or ports to be fractured into to seal production casing below or above the selected, opened port(s) of interest for hydraulic fracturing. Since fracturing fluid is most often conveyed from surface, it may be most efficient to conduct a staged fracturing operation from the most downhole port (i.e., the one closest to the toe of the string) and proceed to frac the ports in order moving up through the string while a sealing device stops fluid from passing below the lowermost port being fractured at that time. To be directed to the selected port or ports, the ports uphole of those selected ports must either be closed or there must be a straddle type sealing device, with seals above and below the selected ports, to ensure that fluids are contained and directed to pass through only the port(s) selected for hydraulic fracturing.

In one embodiment, mechanisms 139, 149 are sliding sleeves moveable by setting a device 147, which includes a sealing element, across which a pressure differential can be established to create a force which is transferred to the sliding sleeve to move the sliding sleeve to the low pressure side. Device 147, as a sealing element, also diverts fluid to the port now opened. Work string 147*a* can move and operate device 147 and may also be in the form of a fluid conducting string, such as coiled tubing, capable of applying axial force downward or upward and conducting fluids. One system that operates like this is called an NCS™-type valve and port opening tool.

Alternatively, the ports could be Packers Plus™-style plug-actuated valves 222, 224, wherein the valves have seats with sized diameters and a suitably sized, untethered plug such as a ball or a dart is launched to land in each seat. A piston effect is generated to open the valve closure to expose the ports 242, 248 and fluid can be injected through the ports to create fractures 2. Such valves may both be similar to the flow regulator of FIG. 14*a* (i.e., the flow regulator main body without small diameter conduit 118" extending alongside), but with a sized ball seat 149*a* constriction on sleeve 149. Such a string may have similarly sized conduits for injection and production.

While fractures 2 are formed, mechanisms 143 remain in injection ports 142 so that fracturing fluids introduced through ports 138 cannot pass through conduit 118". Thereby high pressures can be developed to fracture the formation and any cement in the annulus. Further, mechanisms 143 serve to protect injection conduit 118" from becoming filled with fracturing fluid while fractures are formed.

The fracturing process through production flow regulators 124 is effectively the same, but of course, without concern as to the presence of ports 142.

Figure 12C:
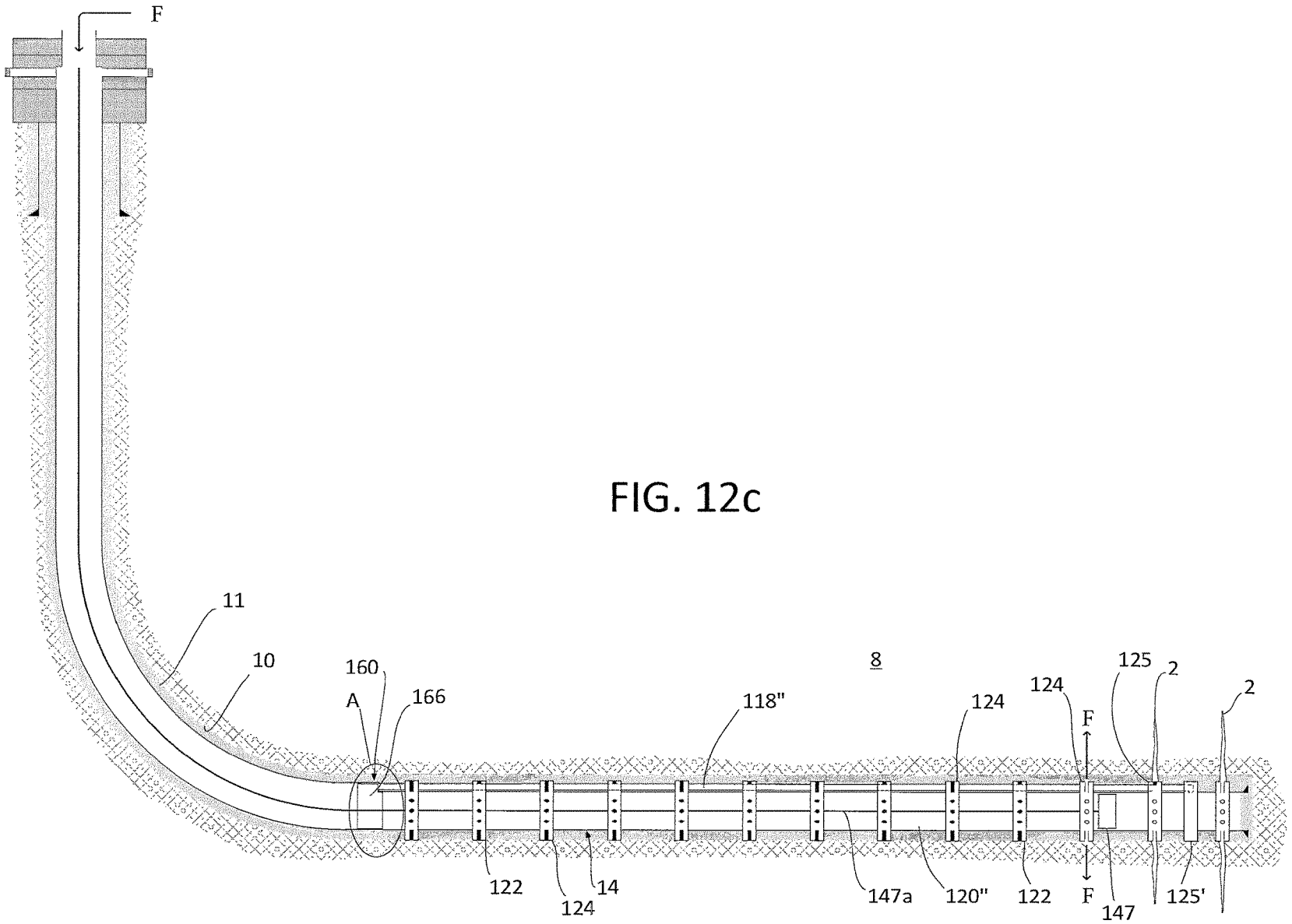

To facilitate fracturing operations, a wellbore installation as shown in FIG. 12*c* could be employed, where upper strings 118', 120' are at least initially omitted, In such an embodiment, the fracturing apparatus such as tool 147 and string 147*a* need only be run into the production tubing 120" in the section to be fractured. Upper strings 118', 120' may be installed after the fracturing and perhaps the flow back processes are complete.

After fractures are formed in the formation, one or more of the injection flow regulators 122 and production flow regulators 124 may be left with their ports 138, 148, respectively, in the open position or are placed in the open position to allow the well to flow back via the production conduit. Fracturing fluids and reservoir fluids can flow into the well via ports 138 of the injection flow regulators and/or ports 148 of the production flow regulators.

Leaving ports 138 and 148 open after fracturing permits recovery of some fracturing fluid and sufficient reservoir fluid to create voidage in the reservoir to enable injection to be established.

After the well produces for some time, the injection flow regulators 122 are placed in the closed configuration or in the injecting configuration (FIG. 13*c*) and one or more production flow regulators 124 left in the open position (FIG. 14*a*), or while one or more production flow regulators may be placed in the closed position.

When it is desired to inject fluids through regulators 122, ports 142 are opened (FIGS. 12*b* and 13*c*), Injection fluid is then pumped down the injection conduit and the injection fluid can exit the injection conduit and flow into the formation via ports 142 of the injection flow regulators 122. The flow direction of the injection fluid is indicated by arrows "I". Because ports 142 are positioned axially close to or in the same axial location, overlapping with, ports 138 from which fractures were formed, the injected fluid can readily flow into the fractures 2 formed by fracturing and into the formation.

Reservoir fluid can continue to flow into the production conduit via ports 148 of any production flow regulators 124 that are in the open position. The flow direction of the reservoir fluid is indicated by arrows "P".

As such, two separate operations occur, each requiring a different well configuration. First, the well is hydraulically fractured through the wellbore installation. Second, after reconfiguration of the installation, for example, to close the injection flow regulators to the production conduit, and possibly to install the upper conduits 118' and 120' if they are not already in place, the process of injection and production can begin. Possibly, after fracturing, the formation may be produced on primary production to deplete reservoir pressure and to create voidage into which injection may be initially established.

String 14 may require crossover tools to permit connections between upper portions 118', 120' and lower portions 118", 120" of the conduits, while maintaining separate flows. FIGS. 15 and 16 show sample tools that may be employed at the crossover to separate the injection conduit and the production conduit at the junction A between the upper portions 118', 120' and the lower portions 118", 120". FIGS. 15 and 16, with the exception of FIGS. 15*c*-15*f*, are shown without having installed the upper portion 120' of the production conduit and the upper portion 118' of the injection conduit.

With reference to FIGS. 12 and 15*a*-15*d*, a junction tool 150 is shown which enables connecting the upper portion 120' to the lower portion 120" of the production conduit, and the upper portion 118' to the lower portion 118" of the injection conduit.

Figure 15B:
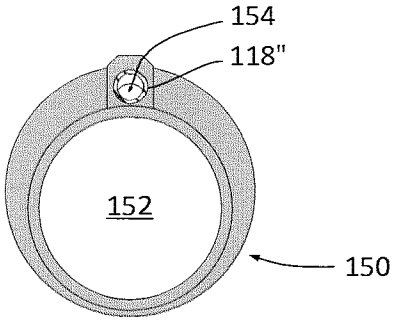
FIGS. 15*a*, 15*b*, 15*c* and 15*d* are a cross-sectional view, an end view, and two cross-sectional views, respectively, of a tool with system parts included and usable in area "A" of the system shown in FIG. 12*a*, according to one embodiment of the invention.
Figure 15A:
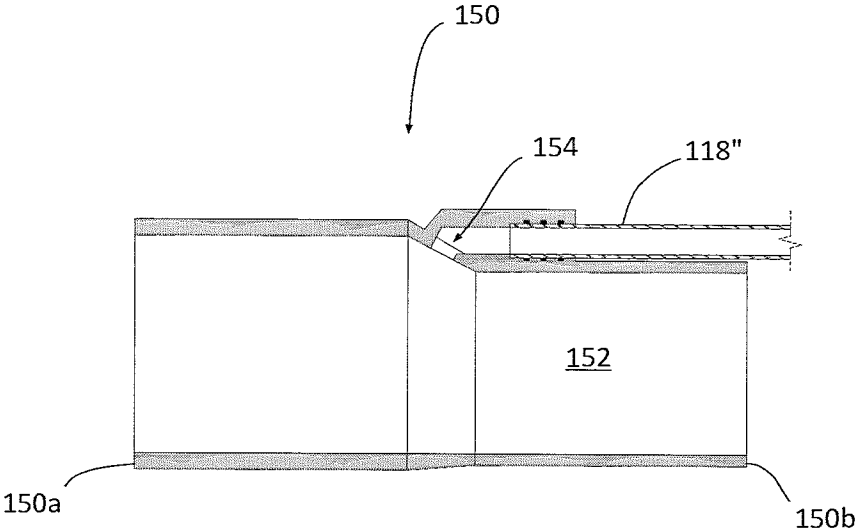
Figure 15C:
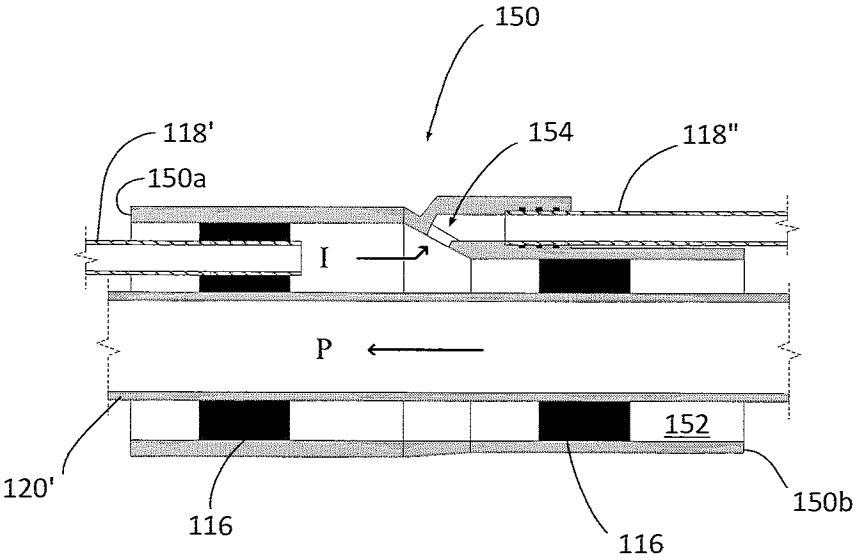
Figure 15D:
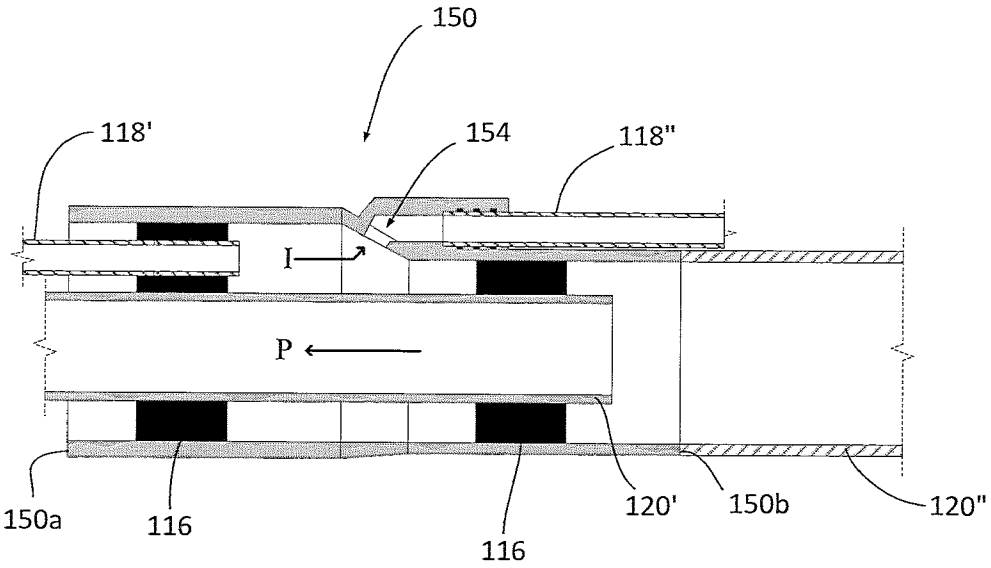

Tool 150 is a tubular member having an axially extending inner bore 152 with an outlet 154 in communication with and stemming from bore 152. An upper end of lower portion 118" of the injection conduit is connected to the outlet. In one embodiment, as shown for example in FIG. 15*c*, the lower ends of the upper portions 118' and 120' are received in bore 152 from an upper end 150*a* of tool 150. Packers 116 are disposed in tool 150 to seal the space between the outer surfaces of the upper portions and the inner surface of tool 150. Packers 116 also allow fluid communication between upper portion 118' and lower portion 118" via outlet 154 while restricting any fluid communication between the production conduit and the injection conduit. The lower end of upper portion 120' extends through inner bore 152 to fluidly connect with the production passage of the uppermost flow regulator. While end 150*b* is illustrated as cut off, it may extend, actually form or be connected to the production conduit 120" below tool 150, in which case tubing shown as 120' may be terminated at the crossover tool 150 as shown in FIGS. 12*b* and 15*d*. In particular, conduit 120' may extend into the horizontal section or may terminate at the junction tool 150 as shown in FIG. 15*d*. If conduit 120' extends into the horizontal section and through production zones, then it may include production flow regulators and/or measurement instrumentation such as distributed fiber optic sensors.

Figure 15E:
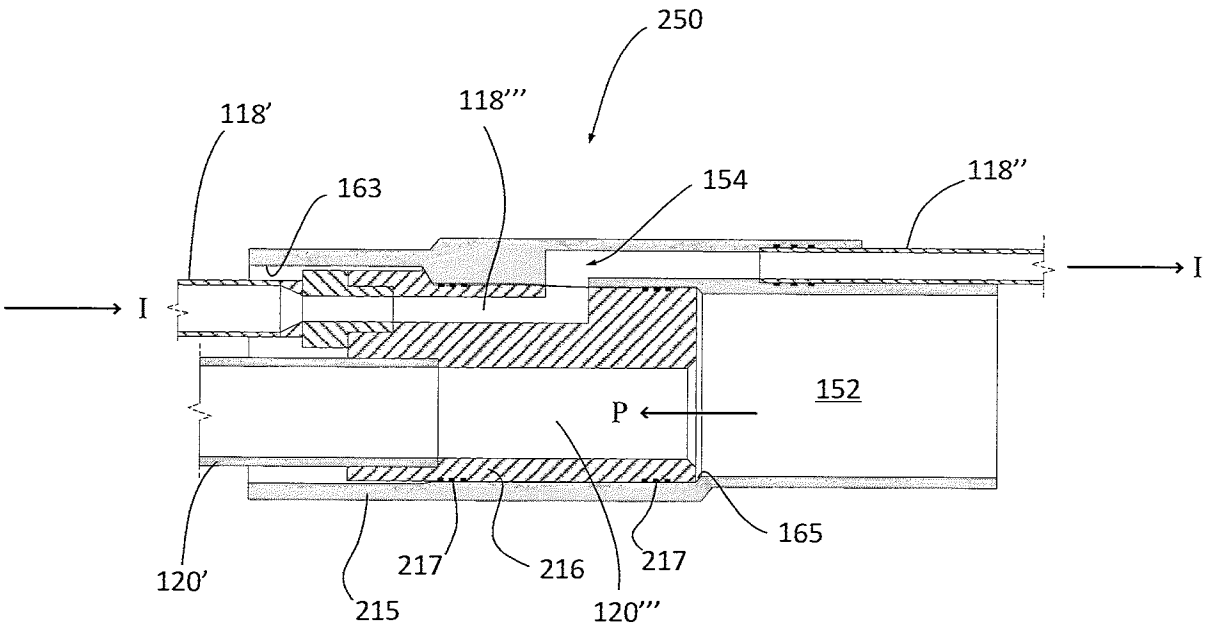
FIGS. 15*e* and 15*f* are a cross-sectional views of another tool usable in area "A" of the system shown in FIG. 12*a*, according to another embodiment of the invention, where
Figure 15F:
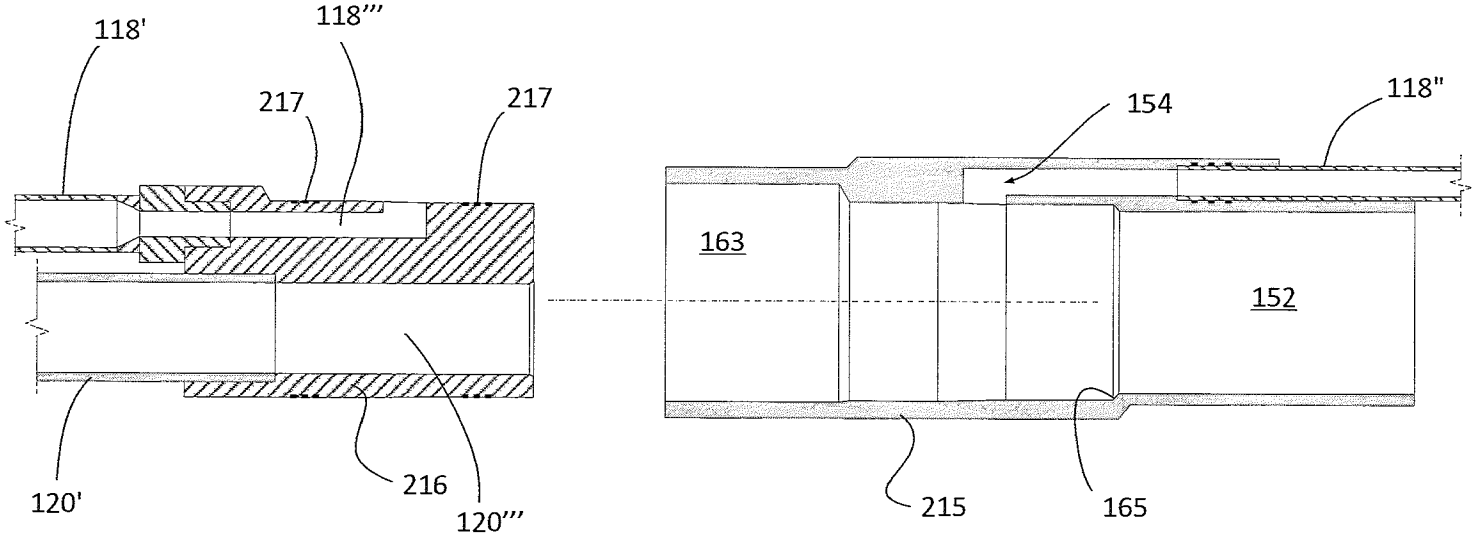

To illustrate possible variations, another junction tool 250 is shown in FIGS. 15*e* and 15*f*, for connecting the upper portion 120' to the lower portion 120" of the production conduit, and the upper portion 118' to the lower portion 118" of the injection conduit.

As with tool 150, junction tool 250 accepts the lower ends of the upper portions 118' and 120' and includes bores that separate and place these ends into communication with the respective upper ends of the lower portions of injection string 118" and production string 120" through bore 152. Junction tool 250 includes a main body 215 with bore 152 and outlet 154 and an insert 216 that is installable therein. Insert 216 includes connections and bore 118'" for connecting the upper portion 118' into fluid communication with outlet 154/end 118" and bore 120'" for connecting the upper portion 120' of production conduit into fluid communication with the bore 152 and therethrough the lower portion production conduit 120". Insert 216 may include exterior seals 217 that land against a seal land in the main body.

Main body 215 can be installed with the lower strings 118", 120" and insert 216 can later be run in from surface and installed into the bore 152 to position seals 217 against a seal land in bore 152. Shouldering may be employed to positively position the insert in the main body. For example, a receptacle may be defined in main body 215 as a larger inner diameter portion 163 of inner bore 152 which terminates at a shoulder 165.

Figure 16B:
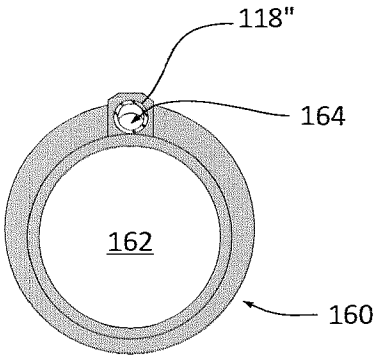
FIGS. 16*a*, 16*b*, 16*c*, and 16*d* are a cross-sectional view, an end view, a cross-sectional view with a fracture isolation sleeve, and an exploded view with a fracture isolation sleeve, respectively, of another tool usable in area "A" of the system shown in FIG. 12*a*, according to another embodiment of the invention.
Figure 16A:
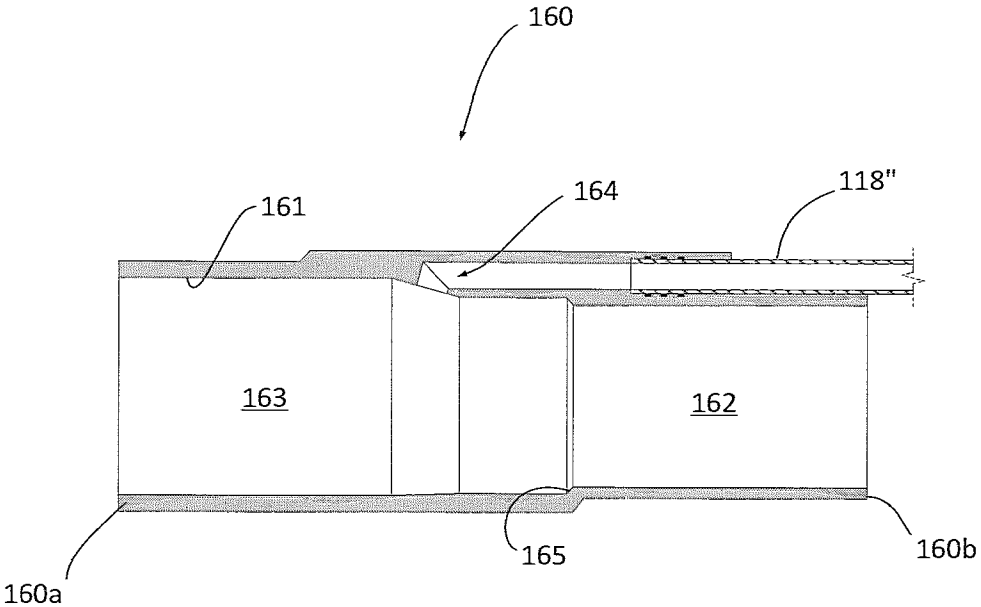
Figure 16C:
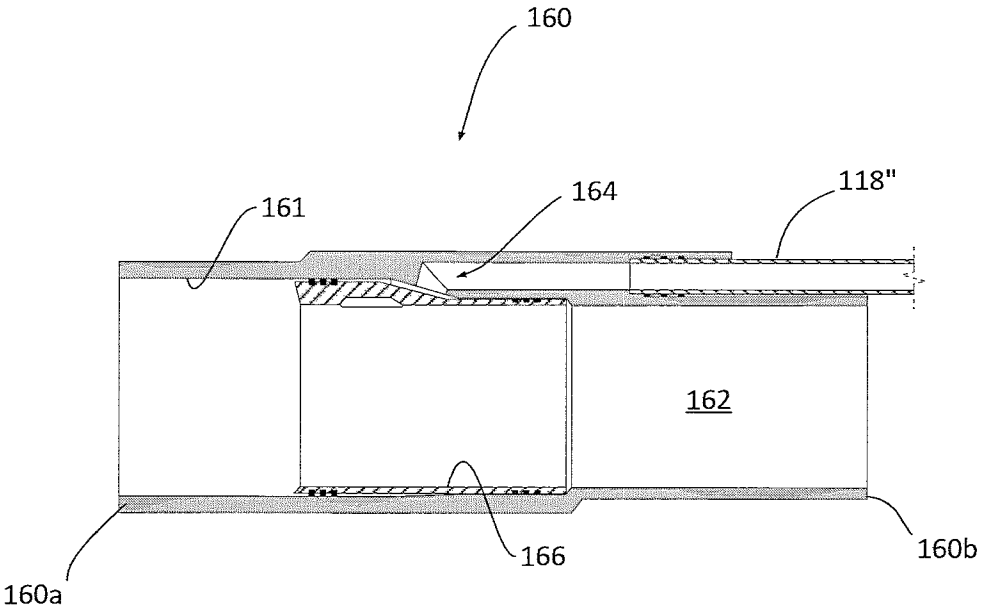
Figure 16D:
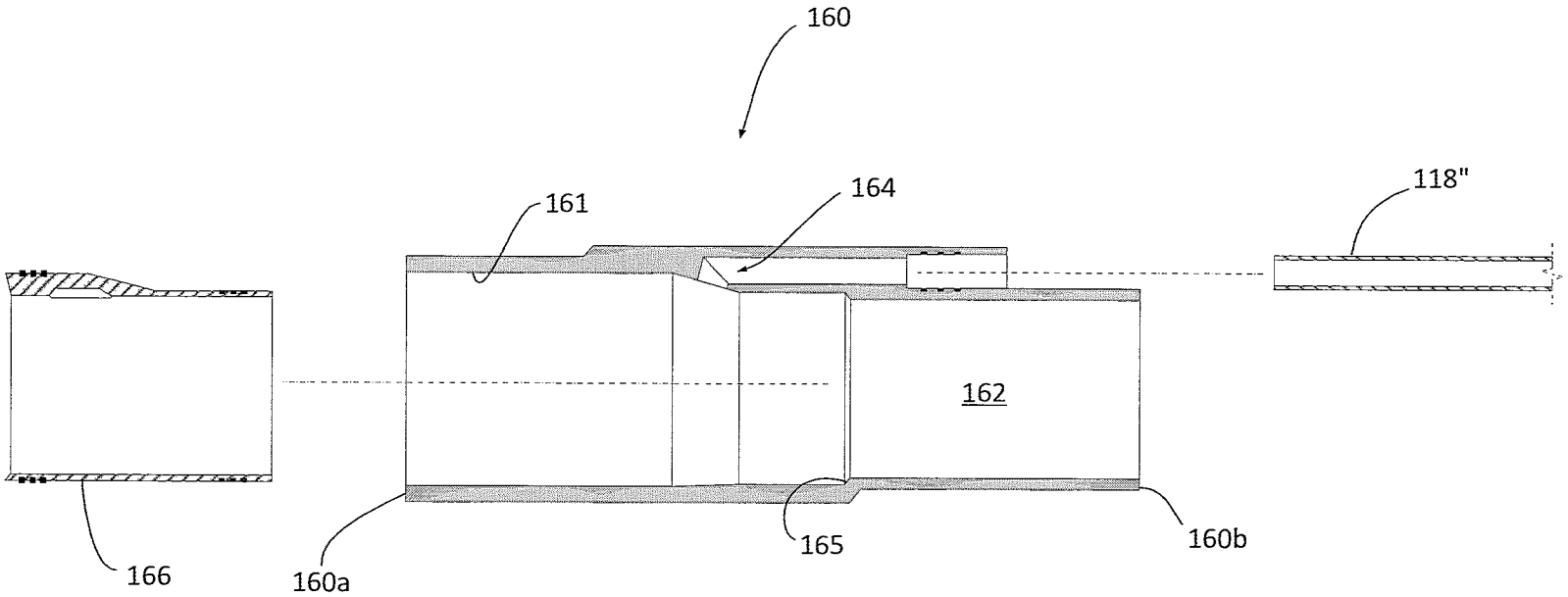

In one embodiment, fracturing occurs before strings 118' and 120' are installed. With reference to FIGS. 12*c* and 16, another possible tool 160 for junction A is shown for isolating lower portion 118" from portion 120" while fracturing such that fracturing fluid and tools can be more readily directed into portion 120". Tool 160 has a main body similar to body 215 with an inner surface 161 defining an axially extending inner bore 162. Lower end 160*b* is connected directly or indirectly to production conduit 120". An outlet 164 stems from the upper section of bore 162 and is in fluid communication with same. An upper end of lower portion 118" of the injection conduit is connected to outlet 164. While tool 160 can later accommodate an assembly of packers 116, etc. as shown within tool 150 of FIG. 15*c* or 12*b* or an insert 216 as shown in FIG. 15*e*, tool 160 offers an open bore for hydraulic fracturing through. To ensure that fracture pressure is conducted from above into production conduit 120" without also passing into injection conduit 118", inner bore 162 is configured to accommodate a pressure isolation sleeve 166 (FIG. 16*c*). For example, pressure isolation sleeve 166 may be positioned in an annular receptacle defined as a larger inner diameter portion 163 of inner bore 162 which terminates at a shoulder 165.

Pressure isolation sleeve 166 is placed in the upper section of bore 162 across outlet 164 for blocking fluid access to the outlet. The outer diameter of pressure isolation sleeve 166 is larger than the inner diameter of the lower section of bore 162, such that as pressure isolation sleeve 166 is pushed down into bore 162, shoulder 165 prevents sleeve 166 from sliding down into the lower section of bore 162.

The sleeve 166 may already be in place when the string is run in or it may be separately run in before hydraulic fracturing. Once in place in the upper section of bore 162, the hydraulic fracturing procedure can begin with fracturing fluid passing from above through tool 160 and into production conduit 120" below. Pressure isolation sleeve 166 restricts fluid communication between bore 162 and outlet 164, thereby preventing any fracturing fluids from entering the lower injection conduit via outlet 164.

After hydraulic fracturing, sleeve 166 is removed from over outlet 164 and may be entirely removed from tool 160. Thereafter, tool 160 may be set up to allow separate injection and production flows therethrough, For example, the lower ends of the upper portions 118' and 120' are respectively positioned in bores 163, 162 from an upper end 160*a* of tool 160. In one embodiment, an insert 216 such as in FIG. 15*e* may be installed. Alternately, packers 116 such as in FIG. 15*c* are disposed in tool 160 to seal the space between the outer surfaces of the upper portions 118', 120' and the inner surface of tool 160.

Figure 17B:
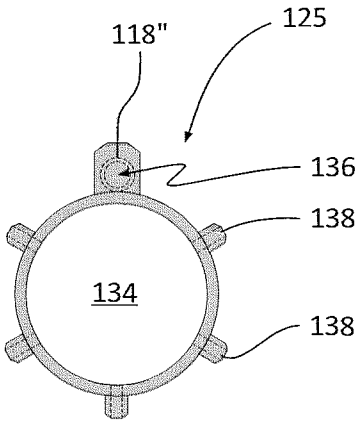
FIGS. 17*a*, 17*b*, and 17*c* are a cross-sectional view showing an open position, an end view, and a cross-sectional view showing a closed position, respectively, of a toe injection flow regulator usable in area "E" of the system shown in FIG. 12*a*, according to one embodiment of the invention.
Figure 17A:
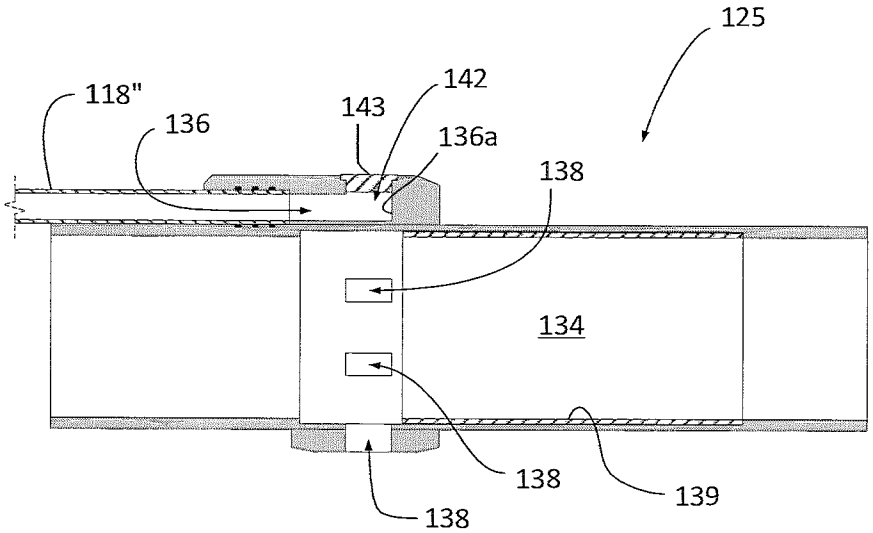

Near the toe of the well, the injection conduit and the production conduit terminate. FIGS. 17 and 18 show two possible injection conduit terminating subs 125, 125' for use at or near the toe of the well. The injection conduit terminating subs may be similar to injection flow regulators 122 along the length of the string except that the injection passage 136 terminates at the injection conduit terminating subs. While two possible subs are shown, it is likely that only one or the other will be employed.

For example, injection conduit terminating sub 125 of FIG. 17 has a production passage 134 and an injection passage 136. As with other injection regulators 122 described above, there are one or more fracturing ports 138 from production passage 134 and a mechanism 139 for selectively opening and closing the one or more ports 138, Injection conduit terminating sub 125 also includes an injection passage 136 that has one or more injection ports 142, possibly with a closing mechanism 143. Injection passage 136 is configured for connecting a lower end of lower portion 118" of the injection conduit and directing all fluids flowing from the injection conduit into injection passage 136 to exit through injection port 142, when port 142 is open, However, injection passage 136 includes an end wall 136*a*, which terminates injection passage 136. Thereby lower portion 118" of injection conduit is terminated at this wall in the injection conduit terminating sub.

Figure 17C:
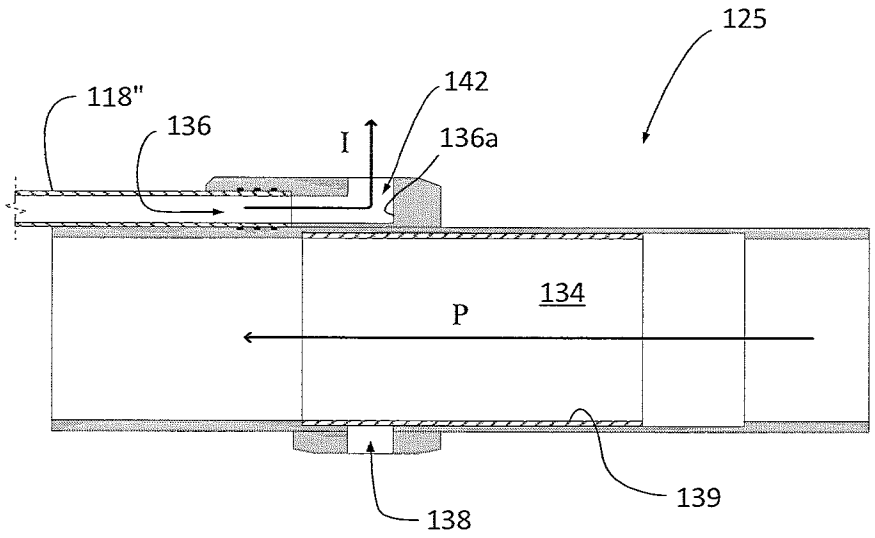

Similar to injection flow regulator 122 described above, injection conduit terminating sub 125 has a closed configuration, a hydraulic fracturing configuration (FIG. 17*a*) and an injecting configuration (FIG. 17*c*).

Figure 18B:
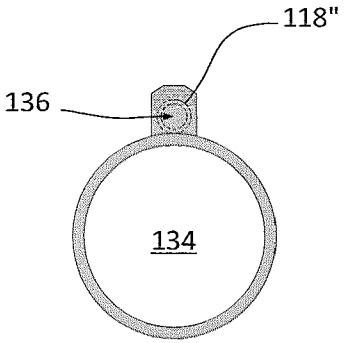
FIGS. 18*a* and 18*b* are a cross-sectional view showing an open position and an end view, respectively, of an injection conduit toe access tool usable in area "E" of the system shown in FIG. 12*a*, according to one embodiment of the invention.
Figure 18A:
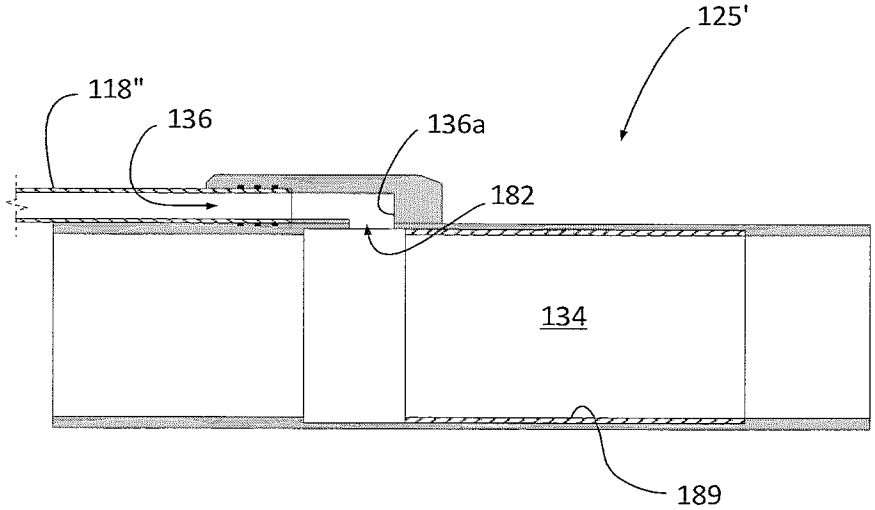

FIGS. 18*a* and 18*b* show another sample injection conduit terminating sub 125'. Injection conduit terminating sub 125' is an alternative to the injection conduit terminating sub described above with respect to FIG. 17*a*. Injection conduit terminating sub 125' allows selected access from its production passage 134 to its injection passage 136 for allowing fluid communication between the injection passage and the production passage. This fluid communication may be useful to permit circulation of fluid through the full length of injection conduit 118" in order to open the injection ports 142 (e.g., by dissolving dissolvable plugs 143) and/or to confirm conductivity or to flush debris from conduit 118".

In particular, sub 125' has one or more ports 182 opening from injection passage 136 to production passage 134. Sub 125' has a mechanism 189 for selectively opening and closing the one or more ports 182. Mechanism 189 may be, for example, a slidable sleeve. The one or more ports 182, when open (as shown), allow fluid communication between the production passage 134 and the injection passage 136. Fluid flow is restricted between same when mechanism 189 is closed, as by moving the sliding sleeve to overlie ports 182.

Injection passage 136 is configured for connecting a lower end of lower portion 118" of the injection conduit and includes an end wall 136*a* for terminating conduit 118" if mechanism 189 is closed. If mechanism 189 is open, wall 136*a* directs all fluids flowing from the injection conduit into injection passage 136 to exit through the one or more ports 182 into the production passage 134 and circulates back up to surface in the production conduit.

While sub 125' is not shown as including injection ports 142 and fracturing ports 138, these ports could be included as desired.

Figure 19:
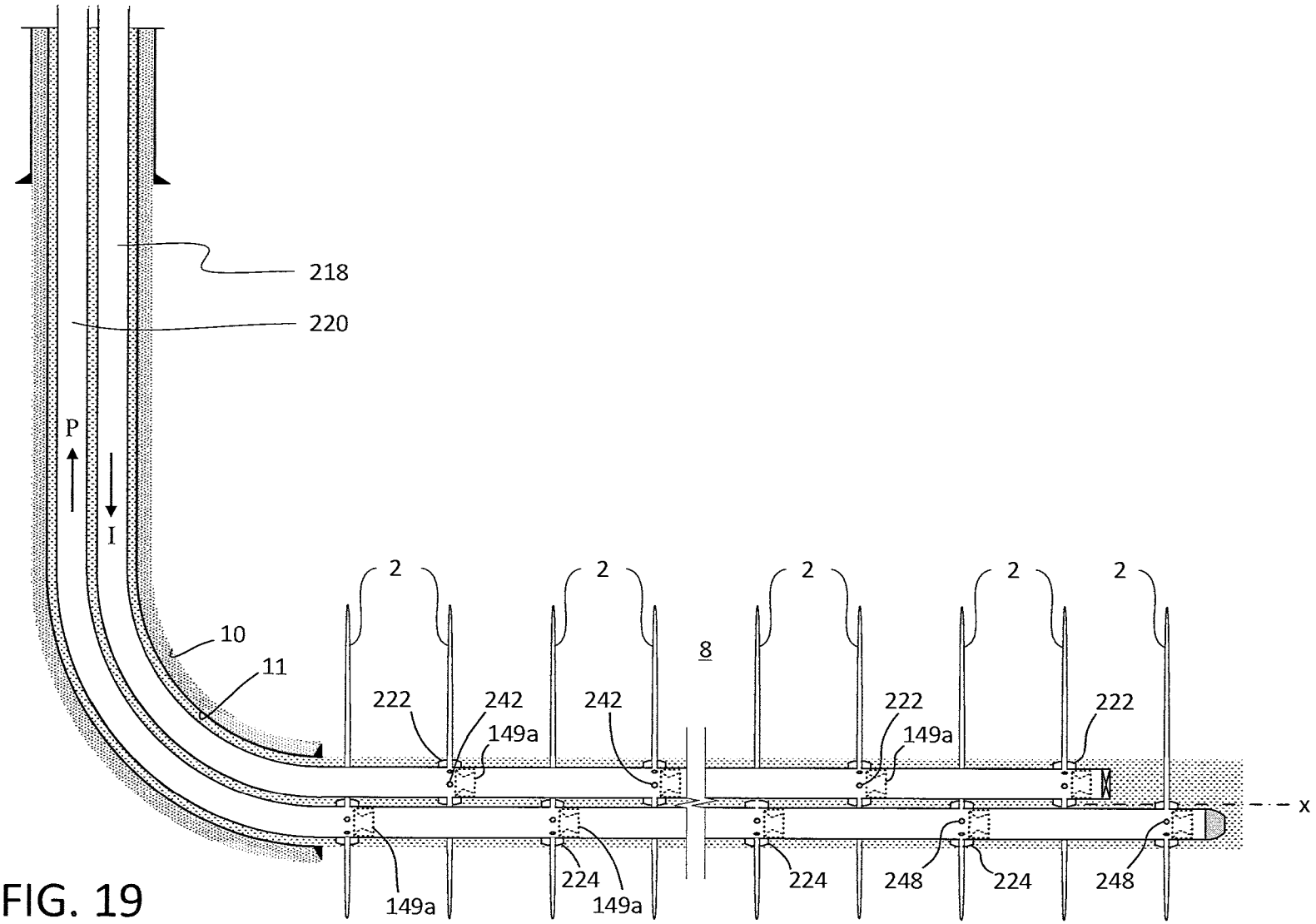
FIGS. 19 and 20 are cross-sectional views of two more embodiments of the invention, where fracturing ports are in each of the production conduit and the injection conduit, these fracturing ports later operate to convey injection fluids and production fluids.
Figure 20:
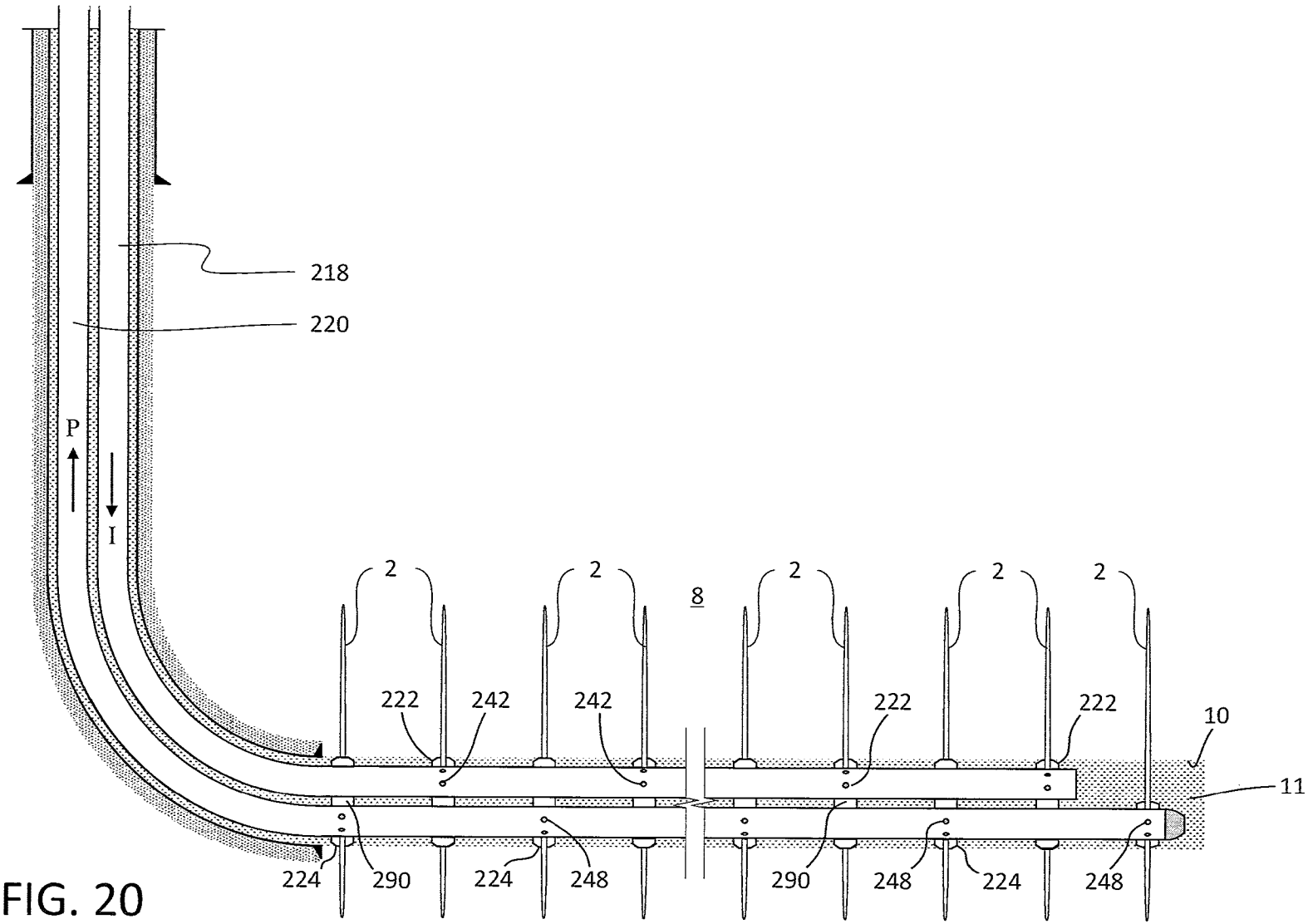

Another embodiment of a wellbore installation that permits initial fracturing is shown in FIGS. 19 and 20. In these embodiments, both the injection conduit 218 and the production conduit 220 are sized to accommodate hydraulic fracturing therethrough. For example, the conduits 218 and 220 have similar outer diameters such as of 2" to 4½", for example each around 2⅞". These strings are both installed in one wellbore, a common wellbore, defined by wall 10 and cement 11 and/or packers are installed to stop fluid migration along the annulus between the strings 218, 220 and the wellbore wall. As noted, the cement or packers offers fluid zonal isolation along the well.

The conduit 218 may include injection flow regulators 222, while production conduit 220 includes a plurality of production flow regulators 224. These flow regulators 222, 224 are configured to both permit fracturing therethrough and either injection or production, respectively.

Each injection flow regulator 222 includes one or more ports 242 through the side wall. The ports 242, when open, provide fluid communication between the regulator's outer surface and the injection passage within the conduit 218 and flow regulator 222, which is connected into the conduit. The ports may be formed downhole, as by perforating, drilling or jetting, or may be preformed. If preformed, a closure mechanism, such as a sliding sleeve, as noted above, may be provided to permit the ports 242 to be opened and closed. The injection flow regulator may have a closed condition, in which the ports are closed and an open condition, when the ports are open. The closed condition may be useful during conduit installation, to effect well control or to prevent injection flow into a particular zone, and thereby a particular hydraulic fracture, and the open condition may be useful during fracturing, back flow and injection operations.

Each production flow regulator 224 may include one or more ports 248 through the side wall. The ports 248, when open, provide fluid communication between the outer surface of flow regular 224 and the production passage within the production conduit 220 and flow regulator 224, which is connected into conduit 220. The ports may be formed downhole, as by perforating or jetting, or may be preformed. If preformed, a closure mechanism, such as a sliding sleeve, as noted above, may be provided to permit the ports 248 to be opened and closed. The production flow regulator may have a closed condition, in which ports 248 are closed and an open condition, when the ports are open. The closed condition may be useful during run in, to effect well control or to prevent production from a particular zone, and thereby a particular hydraulic fracture, and the open condition may be useful during fracturing, back flow and production operations.

Flow regulators 222, 224 may each be substantially the same. The flow regulators permit the formation of fractures 2 or at least permit access to fractures through their respective ports.

As noted, ports 242, 248 may be formed by perforating, jet perforating, drilling or hydrojet perforating. Then a fracturing process may be conducted through the ports. However, since conduits 218, 220 in this embodiment are dual, similarly sized tubing strings extending in parallel, explosive perforating or erosive jetting carries a risk of accidentally perforating through the adjacent tubing, which of course is quite undesirable. In view of this, ports 242, 248 may be preformed avoiding the need for jetting or perforating and the inherent risk of accidentally perforating through the adjacent tubing. The preformed ports may be opened and fractured through.

In one embodiment, flow regulators 222, 224 may be similar to that of FIG. 14*a*, but without the smaller diameter injection conduit extending alongside and may, for example, be an NCS™-type valve actuated by a line-conveyed opening tool.

In another embodiment, the flow regulators may include Packers Plus™-style plug-actuated valves, wherein the valves have seats with sized diameters and suitably sized, untethered plugs such as balls or darts are launched to land in each seat. A piston force is generated due to differential pressure across the seated plug to open the valve closure to expose the ports and fluid can be injected through the ports to create fractures 2. Such flow regulators may be similar to that of FIG. 14*a*, but without the smaller diameter injection conduit extending alongside and with a ball seat on sleeve 149. In an embodiment such as shown in FIG. 19, the flow regulators may include an external body profile which is designed to maintain a relative orientation between the tubings that prevents impingement of hydraulic fracturing, production and injection fluids onto the exterior of the non-ported tubing which is at the same depth as ports 242, 248. Further, the preformed ports 242, 248 may include an external body profile configured to promote the effective placement of cement about the body of the flow regulator to promote both an effective hydraulic annular seal between adjacent injection zones and production zones and an effective hydraulic connection between ports 242, 248 and hydraulic fractures 2. Further yet, the preformed ports 242, 248 may be positioned or located to prevent flow from impinging on the unported adjacent tubing.

In other embodiments, the flow regulators may be other hydraulically and/or electrically actuated valves, such as intelligent completion "interval control valves". Alternately or in addition, the flow regulators may include valves that are controlled by a wireless signal, whether from surface, or a signal sent from a tool in the tubing string including the conduit not subject to hydraulic fracturing.

The conduits, when installed, are in an orientation with injection flow regulators 222 axially offset from the location of production flow regulators 224 such that any communication from one regulator to the other must be through the formation 8 along the long axis x defined by a length of the well. In one embodiment, the injection flow regulators are staggered between the production flow regulators. In other words, an injection flow regulator is positioned between a pair of adjacent production flow regulators.

The conduits may each terminate at their toe ends with a closed end wall, toe sub, cementing sub, etc. In any event, the conduits can be independent without fluid communication therebetween.

The conduits may be independent, simply installed in the same well but free of connections therebetween, as shown in FIG. 19. Alternately, the conduits 218, 220 may be joined by clamps and/or centralizers 290. Clamp 290 may include a collar about each conduit and a spacer therebetween to hold the conduits and space them apart according to the length of the spacer. The centralizer may, as will be appreciated, have a radially extending member to bias the conduits away from the wellbore wall 10. Clamps/centralizers ensure proper orientation of flow regulators and spacing between the conduits 218, 220. This ensures the proper staggered arrangement of flow regulators, orients the ports to prevent erosion of the adjacent conduit and ensures favorable cement placement about and between the conduits to increase the likelihood of hydraulic isolation between zones. While these clamps/centralizers are illustrated installed at each flow regulator 222, 224, more or fewer clamps/centralizers can be installed at other places along the string.

In view of the foregoing description with respect to FIGS. 12*a* to 20, a method is provided herein for producing fluid from a formation having a well extending therein and a string installed in the well. The method comprises:

- injecting high pressure fracturing fluid down the string and out through the injection flow regulators and out through production flow regulators to generate fractures in the formation via the ports (FIG. 12*a*); and
- establishing adjacent injection zones, where fluid (arrows I) is injected from the string into the formation, and production zones, where fluid (arrows P) flows from the formation into the string, along the string by injecting fluid into the formation and allowing production from the formation into the string through the production flow regulators (FIG. 12*b*, FIG. 19 and FIG. 20).

In one embodiment, the method further includes flowing back of fluid from the formation via the ports of both injection flow regulators and the production flow regulators.

In one embodiment, the fracturing into both the injection and the production zones all happens through one string, which eventually ends up handling the production and the method may further include closing the ports of the injection flow regulators through which the fracturing fluid flowed to stop fluid communication between the string and the formation at the injection flow regulators.

In one embodiment, the method further comprises any or all of: running the string into the well with all ports closed, installing annular isolators where an injection flow regulator is positioned axially adjacent a production flow regulator to stop annular communication therebetween, circulating fluid from the injection conduit to the production conduit, injecting fluid from the injection conduit of the injection flow regulators into the generated fractures and thereby into the formation, opening and closing ports, as desired.

While the above description refers to wells with a substantially horizontal section, the present invention may be applied to vertical wells and/or deviated wells.

For horizontal wells, the above described intra-well, simultaneous injection/production enhanced recovery methods and systems may have advantages over inter-well enhanced recovery schemes. For example, the present invention may lead to rapid production response to fluid injection due to reduced spacing between injection and production zones. In addition, the present invention may lead to higher recovery of reservoir oil due to more efficient sweep of injected fluids within the reservoir, between injection and production zones each having hydraulic fractures with substantially parallel orientation and positioned along the horizontal section of the well. In addition, the present invention may allow simultaneous injection and production in the same wellbore without the need of converting the entire wellbore for only injection. Therefore, the present invention may lead to greater hydrocarbon recovery due to a combination of high sweep efficiency particularly with the injection of a miscible solvent gas and high areal sweep efficiency of a line drive pattern between substantially parallel hydraulic fractures. Additional advantages may include pressure maintenance to arrest reservoir pressure decline and resulting gas lift of liquid hydrocarbon in the wellbore upon recovery of solvent gas injection.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. For U.S. patent properties, it is noted that no claim element is to be construed under the provisions of 35

USC 112, sixth paragraph, unless the element is expressly recited using the phrase "means for" or "step for".

What is claimed is:

1. A method for reservoir fluid production from a well having a wellbore in communication with a formation containing the reservoir fluid, comprising:

injecting fracturing fluid through a string into the formation to create fractures in predetermined zones along the wellbore;

supplying injection fluid to the wellbore via the string;

injecting the injection fluid from the wellbore to the formation through a first set of fractures defined in a first set of zones, while blocking fluid communication between the formation and the wellbore through a second set of fractures defined in a second set of zones;

ceasing the supply of the injection fluid;

blocking fluid communication between the formation and the wellbore through the first set of fractures;

permitting fluid communication between the formation and the wellbore through the second set of fractures to enable reservoir fluid to flow from the formation into the wellbore; and transporting the reservoir fluid in the wellbore to surface via the string.

2. The method of claim 1, wherein fluid communication between the formation and the wellbore is at least partially controlled via frac valves operatively mounted along the string proximate the predetermined zones, and wherein each frac valve comprises a flow regulator selectively operable to control fluid communication between the wellbore and the formation along their corresponding zone.

3. The method of claim 2, wherein each zone of the first and second sets of zones is provided with at least one of the frac valves, and wherein each frac valve comprises one or more frac ports.

4. The method of claim 2, wherein the flow regulator includes any one of a slidable sleeve, a choked orifice, one or more tubes, a restricted flow path, or a combination thereof.

5. The method of claim 4, wherein the flow regulator is adapted to selectively allow fluid communication between the formation and the wellbore based on a viscosity of the fluid, a density of the fluid, a fluid phase of the fluid, or a combination thereof.

6. The method of claim 5, wherein fracturing fluid is injected from the string and into the formation through the frac ports, and wherein reservoir fluid is permitted to flow from the formation and into the string through the frac ports.

7. The method of claim 2, wherein the frac valves installed along the first set of zones comprise an injection port adapted to enable injecting injection fluid into the formation through the first set of fractures.

8. The method of claim 2, wherein the first set of zones and the second set of zones are fluidly sealed from one another through an annulus in the wellbore.

9. The method of claim 1, wherein zones from the first set of zones and zones from the second set of zones alternate each other along the wellbore.

10. The method of claim 1, wherein the string comprises a cemented casing extending along at least a portion of the wellbore, and wherein the fractures are created by injecting fracturing fluid through the cemented casing.

11. The method of claim 10, wherein the cemented casing is perforated at the predetermined zones to create perforations, with the fracturing fluid being injected into the formation through the perforations.

12. The method of claim 11, wherein the perforations are subsequently sealed to prevent the fracturing fluid from re-entering the wellbore.

13. The method of claim 12, wherein the perforations are sealed using ball sealers.

14. The method of claim 11, wherein the perforations are created through the cemented casing via jet perforation, wireline jet perforation, hydra jet perforation, or a combination thereof.

15. A method for reservoir fluid production from a well having a wellbore string in communication with a formation containing the reservoir fluid, comprising:

injecting fracturing fluid through flow regulators of the wellbore string into the formation to create fractures in predetermined zones along the wellbore;

supplying injection fluid down the wellbore string;

injecting injection fluid from the wellbore string to the formation through injection flow regulators substantially aligned with a first set of fractures defined in a first set of zones, while blocking fluid communication between the wellbore string and the formation through production flow regulators substantially aligned with a second set of fractures defined in a second set of zones;

ceasing the supply of injection fluid and blocking fluid communication between the formation and the wellbore string through the injection flow regulators;

permitting fluid communication between the formation and the wellbore string through the production flow regulators to enable reservoir fluid to flow from the formation into the wellbore string; and transporting the reservoir fluid in the wellbore string to surface.

16. The method of claim 15, wherein the fracturing fluid is injected through each one of the flow regulators substantially simultaneously.

17. The method of claim 15, wherein the injection flow regulators and the production flow regulators are positioned alternately along a length of the wellbore string to enable staggering injection and production operations.

18. The method of claim 15, wherein the injection flow regulators and the production flow regulators are provided with at least one valve selectively operable to establish fluid communication between the wellbore string and the formation, and wherein each valve is operable to convey fracturing pressure to the formation in order to generate the fractures therein.

19. A method for reservoir fluid production from a well having a wellbore in communication with a formation containing the reservoir fluid, comprising:

injecting fracturing fluid through a string into the formation to create fractures in predetermined zones along the wellbore;

supplying injection fluid to the wellbore via the string;

injecting the injection fluid from the wellbore to the formation through a first set of fractures defined in a first set of zones;

producing reservoir fluid from the formation through a second set of fractures defined in a second set of zones, wherein injecting the injection fluid to the formation and producing reservoir fluid from the formation are performed alternately; and transporting the reservoir fluid in the wellbore to surface via the string.

20. A well completion system for producing reservoir fluids from a reservoir via a wellbore provided in the reservoir, comprising:

a wellbore string extending along the wellbore and comprising an injection conduit defining an injection fluid passage adapted to convey injection fluid to the reservoir, and a production conduit defining a production fluid passage adapted to convey production fluid from the reservoir to surface; and a frac valve system coupled to the injection and production conduits, the frac valve system comprising a plurality of frac valves having respective frac ports operable to enable the injection of fracturing fluid therethrough for fracturing the reservoir, the frac ports being defined through one of the injection and production conduits to enable conveyance of the fracturing fluid from the wellbore string to the reservoir via a single conduit; and wherein the wellbore string and the frac valve system are configured to alternately (i) inject the injection fluid into the formation and (ii) produce reservoir fluid from the formation.

21. The well completion system of claim 20, wherein the fracturing fluid is conveyed to the plurality of frac valves simultaneously or consecutively.

22. The well completion system of claim 20, wherein the plurality of frac valves comprises injection valves which further include an injection port adapted to enable injection of injection fluid into fractures created in the reservoir.

23. The well completion system of claim 20, wherein the wellbore is one of a horizontal wellbore, a vertical wellbore, and a deviated wellbore.

* * * * *